US011065870B2

(12) United States Patent
Mizuno

(10) Patent No.: US 11,065,870 B2
(45) Date of Patent: Jul. 20, 2021

(54) LIQUID EJECTION HEAD HAVING PLURALITY OF SETS OF ROWS OF PRESSURE CHAMBERS, AND CAPABLE OF AVOIDING MIXTURE OF DIFFERENT KINDS OF LIQUID

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 48 days.

(21) Appl. No.: 16/432,326

(22) Filed: Jun. 5, 2019

(65) Prior Publication Data

US 2020/0079081 A1 Mar. 12, 2020

(30) Foreign Application Priority Data

Sep. 12, 2018 (JP) ..... JP2018-170937

(51) Int. Cl.
*B41J 2/055* (2006.01)
*B41J 2/03* (2006.01)
*B41J 2/14* (2006.01)

(52) U.S. Cl.
CPC ..... *B41J 2/055* (2013.01); *B41J 2/03* (2013.01); *B41J 2/14032* (2013.01)

(58) Field of Classification Search
CPC . B41J 2202/12; B41J 2/175; B41J 2/18; B41J 2002/14362; B41J 2002/14419
See application file for complete search history.

(56) References Cited

U.S. PATENT DOCUMENTS

2013/0201255 A1* 8/2013 Dowell ..... B41J 2/1621 347/44
2014/0292963 A1 10/2014 Hara et al.
2016/0288498 A1* 10/2016 Hayashi ..... B41J 2/14233
2017/0182775 A1* 6/2017 Hollands ..... B41J 2/14201
2017/0326877 A1* 11/2017 Kobayashi ..... B41J 2/14209
2018/0056661 A1 3/2018 Kaneko et al.
(Continued)

FOREIGN PATENT DOCUMENTS

JP 2013-067178 A 4/2013
JP 2017-144634 A 8/2017

OTHER PUBLICATIONS

Dec. 12, 2019—(EP) Extended EP Search Report—App 19178647.4.

*Primary Examiner* — John Zimmermann
(74) *Attorney, Agent, or Firm* — Banner & Witcoff, Ltd.

(57) ABSTRACT

A liquid ejection head includes a plurality of sets of a first row, a second row, and a flow path in communication with the first row and the second row. Each of the plurality of sets is provided for each respective one of a plurality of kinds of liquids different from one another. The first row includes a plurality of first pressure chambers. The second row includes a plurality of second pressure chambers. The second row is positioned beside the first row. The flow path is in communication with the plurality of first pressure chambers and the plurality of second pressure chambers. The flow path includes a plurality of first communication passages, a plurality of second communication passages, a plurality of third communication passages, a plurality of fourth communication passages, a first manifold, a second manifold, and a common manifold.

21 Claims, 11 Drawing Sheets

(56) References Cited

U.S. PATENT DOCUMENTS

| | | | | |
|---|---|---|---|---|
| 2018/0222190 | A1* | 8/2018 | Thelander | B41J 2/175 |
| 2018/0222198 | A1* | 8/2018 | Thelander | B41J 2/14145 |
| 2019/0217616 | A1* | 7/2019 | Mu | B41J 2/175 |

* cited by examiner

LIQUID EJECTION HEAD HAVING PLURALITY OF SETS OF ROWS OF PRESSURE CHAMBERS, AND CAPABLE OF AVOIDING MIXTURE OF DIFFERENT KINDS OF LIQUID

CROSS REFERENCE TO RELATED APPLICATION

This application claims priority from Japanese Patent Application No. 2018-170937 filed Sep. 12, 2018. The entire content of the priority application is incorporated herein by reference.

TECHNICAL FIELD

The present disclosure relates to a liquid ejection head.

BACKGROUND

Japanese Patent Application Publication No. 2013-67178 discloses an ink jet head. The ink jet head includes a head board where two rows of plurality of pressure chambers, an ink drainage passage, and a pair of ink supply passages are formed. The ink drainage passage is formed between the two rows. The two rows of pressure chambers and the ink drainage passage is positioned between the pair of ink supply passages. The ink supply passages are connected to a tank through an inlet tube, and the ink drainage passage is connected to the tank through an outlet tube.

SUMMARY

The pressure chambers described in the Japanese Patent Application Publication No. 2013-67178 is configured to allow a single kind of liquid to flow therethrough. This publication does not disclose the pressure chambers allowing a plurality of kinds of liquids to flow therethrough. Therefore, communalization of the inlet tube for the pressure chambers each in communication with each of the plurality of kinds of liquids may lead to mixture of the plurality of kinds of liquids.

In view of the foregoing, it is an object of the disclosure to provide a liquid ejection head capable of avoiding mixing of colors of liquids.

In order to attain the above and other objects, according to one aspect, the disclosure provides a liquid ejection head which includes a plurality of sets of a first row, a second row, and a flow path in communication with the first row and the second row. Each of the plurality of sets are provided for each respective one of a plurality of kinds of liquids different from one another. The first row includes a plurality of first pressure chambers arrayed in line in an array direction. The second row includes a plurality of second pressure chambers arrayed in line in the array direction. The second row is positioned beside the first row in a widthwise direction perpendicular to the array direction. The flow path is in communication with the plurality of first pressure chambers and the plurality of second pressure chambers. The flow path includes a plurality of first communication passages, a plurality of second communication passages, a plurality of third communication passages, a plurality of fourth communication passages, a first manifold, a second manifold, and a common manifold. The plurality of first communication passages are each in communication with each of the first pressure chambers at a position close to the second row in the widthwise direction. The plurality of second communication passages are each in communication with each of the first pressure chambers at a position away from the second row in the widthwise direction. The plurality of third communication passages are each in communication with each of the second pressure chambers at a position close to the first row in the widthwise direction. The plurality of fourth communication passages are each in communication with each of the second pressure chambers at a position away from the first row in the widthwise direction. The first manifold is in communication with the plurality of first pressure chambers through the plurality of second communication passages. The second manifold is in communication with the plurality of second pressure chambers through the plurality of fourth communication passages. The common manifold is positioned between the first manifold and the second manifold in the widthwise direction, and the common manifold is in communication with the plurality of first pressure chambers through the plurality of first communication passages and in communication with the plurality of second pressure chambers through the plurality of third communication passages.

According to another aspect, the disclosure provides a a liquid ejection head including a first plate, a damper plate, and a second plate. The first plate is formed with the first manifold, the second manifold, and the common manifold. The damper plate is laminated on the first plate, and elastically deformable. The second plate is laminated on the damper plate. The second plate has a surface facing the damper plate. The surface is formed with damper grooves. One of the damper grooves is positioned in overlapping relation with the first manifold. Another one of the damper grooves is positioned in overlapping relation with the second manifold. Still another one of the damper grooves is positioned in overlapping relation with the common manifold in a laminating direction perpendicular to the array direction and the widthwise direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

First Embodiment

Figure 1:
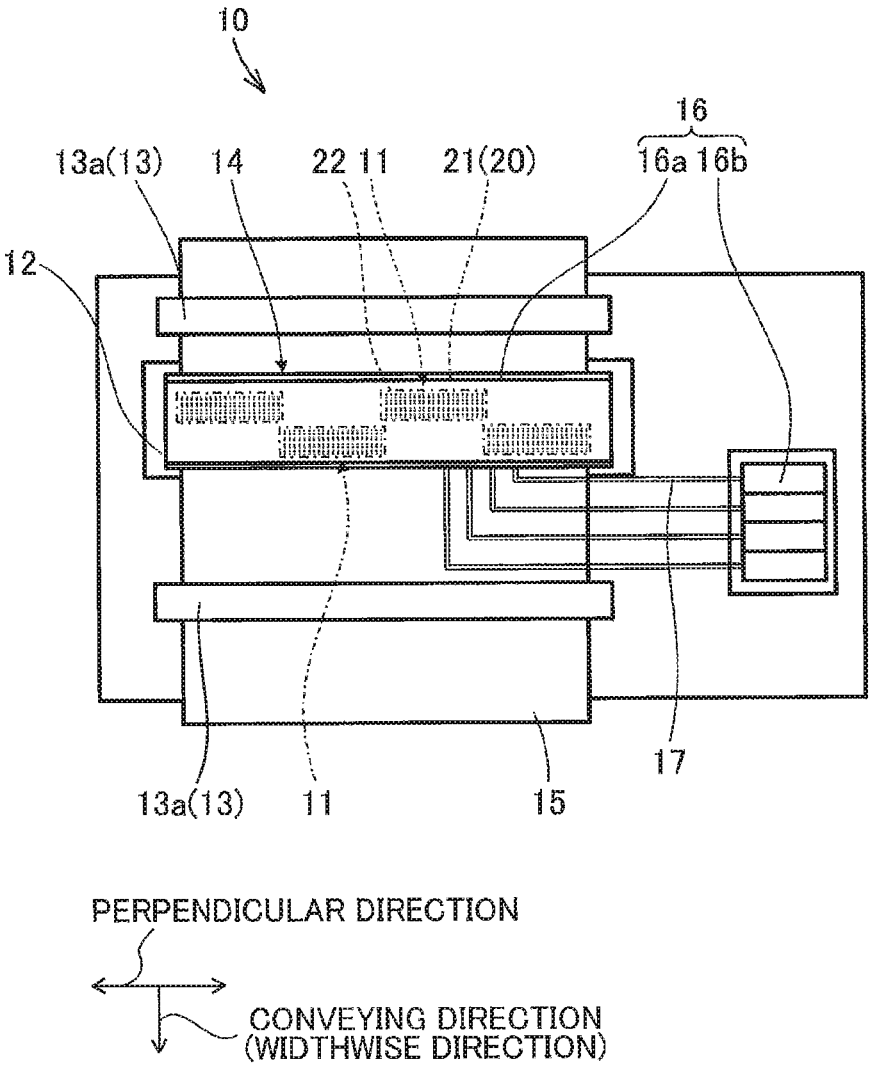
FIG. 1 is a schematic view of a liquid ejection device provided with a head according to a first embodiment.

A liquid ejection head 11 according to a first embodiment will be described with reference to FIGS. 1 through 3. The liquid ejection head 11 is provided in a liquid ejection device 10 such as an ink jet printer.

[Structure of Liquid Ejection Device]

The liquid ejection device 10 includes a platen 12, a conveying mechanism 13, and a line head 14. The platen 12 is a support on which a sheet 15 is mountable. The conveying mechanism 13 includes a pair of conveyer rollers 13*a*, 13*a*. The platen 12 is positioned between the pair of conveyer rollers 13*a* and 13*a* in a conveying direction so that the sheet 15 is conveyed in the conveying direction by the pair of conveyer rollers 13*a*, 13*a*.

The line head 14 extends in a longitudinal direction by a length greater than a widthwise length of the sheet 15. The longitudinal direction is perpendicular to the conveying direction, and is an example of "perpendicular direction.". The line head 14 includes a plurality of heads 11. The head 11 includes an ejection plate 20 whose ejection surface 21 is formed with a plurality of ejection openings 22 arrayed with each other in an array direction. Details of the head 11 will be described in detail. Further, the array direction is perpendicular to the conveying direction. In this case, the array direction is the same as the perpendicular direction. Alternatively, the array direction may cross the conveying direction.

Each ejection opening 22 is fluidly connected to a tank 16. The tank 16 includes a sub-tank 16*a* positioned on the line head 14, and a storage tank 16*b* connected to the sub-tank 16*a* through a tube 17. Liquid is stored in the sub-tank 16*a* and the storage tank 16*b*. Numbers of the tanks 16 corresponds to numbers of colors of liquids to be ejected from the ejection openings 22. For example, four tanks 16 are provided for four colors of black, yellow, cyan and magenta. Thus, the line head 14 is configured to eject a plurality of kinds of liquids.

The line head 14 is movable but is fixed at a position, and is configured to eject liquid from the plurality of ejection openings 22, while the sheet 15 is moved by the conveying mechanism 13 in the conveying direction. Thus an image is formed on the sheet 15. Instead of the line head 14, a serial head is available which is movable in the perpendicular direction.

[Structure of Head]

The longitudinal direction of the head 11 corresponds to the "perpendicular direction" and "array direction", and the line head 11 also defines a widthwise direction perpendicular to the longitudinal direction and corresponds to the conveying direction. As illustrated in FIGS. 2 and 3, the head 11 includes an ejection plate 20, a pressure chamber plate 30, a vibration plate 40, an accommodation plate 50, and a first plate 60. Each of the plates is rectangular flat plate shaped, and is made from silicon, resin, or metal.

These plates are laminated one after another in this order and neighboring plates are joined together by an adhesive agent. A direction of lamination (laminating direction) is perpendicular to the array direction and the widthwise direction, and the widthwise direction is perpendicular to the array direction. In the following description, the terms "above" and "below" are used such that the ejection plate 20 is positioned below the pressure chamber plate 30, and the pressure chamber plate 30 is positioned above the ejection plate 20. However, orientation of the head 11 is not limited to this orientation.

The ejection plate 20 is formed with a plurality of nozzles 23 extending through a thickness thereof in the laminating direction. The ejection plate 20 has a lower surface functioning as an ejection surface 21 where the nozzles 23 are open. The nozzle 23 has an open end which is the ejection opening 22.

The plurality of ejection openings 22 are arrayed one after another in the array direction to form a row of ejection openings 24. Eight rows of the ejection openings 24 are arrayed in the widthwise direction. A pair of the ejection openings 24 neighboring in the widthwise direction corresponds to one color of liquid, and thus, four pairs of the neighboring ejection openings 24 correspond to four colors of liquids such as black, yellow, cyan, and magenta, respectively.

The pressure chamber plate 30 is formed with a plurality of pressure chambers 31. Each pressure chamber 31 is in communication with each nozzle 23. The pressure chamber 31 is a part of a discrete channel, and each of the discrete channels is in communication with each nozzle 23.

The pressure chamber 31 is defined by a through-hole formed in the pressure chamber plate 30 in the laminating direction and in communication with the nozzle 23. The through-hole has a lower end covered with the ejection plate 20. The pressure chamber 31 is rectangular parallelepiped whose longitudinal direction is coincident with the widthwise direction. Each nozzle 23 is positioned at a center in the widthwise direction of each pressure chamber 31.

A plurality of the pressure chambers 31 are arrayed in line in the array direction one after another to form a row of pressure chambers 32. A plurality of rows of pressure chambers 32 (eight rows of pressure chambers 32 in this embodiment) extends in parallel to each other and arrayed in the widthwise direction. A pair of the rows of pressure chambers 32 neighboring in the widthwise direction such as a row of first pressure chambers 32*a* and a row of second pressure chambers 32*b* are connected to an identical tank 16 (FIG. 1).

The vibration plate 40 is positioned opposite to the ejection plate 20 with respect to the pressure chamber 31. The vibration plate 40 includes an elastic membrane 41 and an insulating membrane 42. The elastic membrane 41 is positioned on an upper surface of the pressure chamber plate 30 and is elastically deformable in the laminating direction. The insulating membrane 42 covers an upper surface of the elastic membrane 41 and is made from an electrically insulating material. The vibration plate 40 is formed with a plurality of pairs of communication passages 43, each pair being in communication with each pressure chamber 31.

The accommodation plate 50 is positioned opposite to the pressure chamber plate 30 with respect to the vibration plate 40. That is, the accommodation plate 50 is positioned on an upper surface of the insulating membrane 42. The accommodation plate 50 is formed with a plurality of pairs of communication passages, each pair being in communication with each pair of communication passages 43. The accommodation plate 50 is also formed with a plurality of accommodation spaces 55.

The plurality of pairs of communication passages includes a first pair of first communication passage 51 and a second communication passage 52 for a first pressure chamber 31*a* and a second pair of a third communication passage 53 and a fourth communication passage 54 for a second pressure chamber 31*b*. That is, two pairs of communication passages are provided for each color. According to the present embodiment, sixteen communication passages are formed in one head 11. Therefore, four sets of two pairs of communication passages are provided for four colors.

Each of the communication passages extends through the accommodation plate 50 in the laminating direction and is in communication with each pressure chamber 31 through each communication passage 43 of the vibration plate 40. The pair of first communication passage 51 and second communication passage 52 is fluidly connected to the first pressure chamber 31*a* constituting the row of first pressure chambers 32*a*, and the pair of third communication passage 53 and fourth communication passage 54 is fluidly connected to the second pressure chamber 31*b* constituting the row of second pressure chambers 32*b*. Thus, each pair of communication passages is provided for each pressure chamber 31.

The accommodation space 55 is positioned between the first communication passage 51 and the second communication passage 52 in the widthwise direction, and remaining one of the accommodation spaces 55 is positioned between the third communication passage 53 and the fourth communication passage 54 in the widthwise direction. Further, the first communication passage 51 and the third communication passage 53 are positioned close to each other and between the second communication passage 52 and the fourth communication passage 54 in the widthwise direction.

Hence, the first communication passage 51 is in communication with the first pressure chamber 31*a* at a position close to the row of second pressure chambers 32*b*, and the second communication passage 52 is in communication with the first pressure chamber 31*a* at a position farther from the row of second pressure chambers 32*b* than the first communication passage 51 is from the row of second pressure chambers 32*b*. Further, the third communication passage 53 is in communication with the second pressure chamber 31*b* at a position close to the row of first pressure chambers 32*a*, and the fourth communication passage 54 is in communication with the second pressure chamber 31*b* at a position farther from the row of first pressure chambers 32*a* than the third communication passage 53 is from the row of first pressure chambers 32*a*.

The accommodation space 55 provides an internal space of the accommodation plate 50, and is recessed upward from a lower surface of the accommodation plate 50. For example, the accommodation space 55 is rectangular parallelepiped shaped, and elongated in the array direction. The plurality of accommodation spaces 55 are arrayed in the arraying direction, and a piezoelectric element 56 is accommodated in each of the accommodation spaces 55.

Each of the piezoelectric elements 56 is positioned on the vibration plate 40 at a position overlapping with each of the pressure chambers 31 in the laminating direction. The piezoelectric element 56 includes a common electrode 57, a piezoelectric body 58 and a discrete electrode 59, these being laminated in this order. The common electrode 57 is commonly operated for the plurality of the piezoelectric elements 56, and is laminated on an upper surface of the vibration plate 40 so as to cover a portion of the vibration plate 40 entirely, the portion defining each pressure chamber 31. The common electrode 57 extends over the row of first pressure chambers 32*a*. The piezoelectric body 58 and the discrete electrode 59 are provided for each pressure chamber 31, and is positioned above the pressure chamber 31.

Upon application of voltage to the discrete electrode 59, the piezoelectric body 58 is deformed, so that the vibration plate 40 is displaced in the laminating direction. Because of the displacement of the vibration plate 40 toward the pressure chamber 31, internal volume of the pressure chamber 31 is reduced to apply pressure to the liquid in the pressure chamber 31, thereby ejecting the liquid through the nozzle 23 in communication with the pressure chamber 31.

A plurality of manifolds including a first manifold 61, a second manifold 62 and a common manifold 63 are formed in the first plate 60. These manifolds 61, 62, 63 extend through the first plate 60 in the laminating direction. Each lower end of each of the manifolds 61, 62, 63 is covered by an upper surface of the accommodation plate 50.

Each of the manifolds 61, 62, 63 is elongated in the array direction, and is parallel to each other with an interval between neighboring manifolds in the widthwise direction. The common manifold 63 is positioned between the first manifold 61 and the second manifold 62 in the widthwise direction. These manifolds 61, 62, 63 provide the longitudinal direction which is the array direction.

The first manifold 61 is in communication with the plurality of first pressure chamber 31*a* constituting the row of first pressure chambers 32*a* through the plurality of second communication passages 52. The second manifold 62 is in communication with the plurality of second pressure chamber 31*b* constituting the row of second pressure chambers 32*b* through the plurality of fourth communication passages 54. The common manifold 63 is in communication with the plurality of first pressure chamber 31*a* constituting the row of first pressure chambers 32*a* through the plurality of first communication passages 51 and is in communication with the plurality of second pressure chamber 31*b* constituting the row of second pressure chambers 32*b* through the plurality of third communication passages 53.

In the present embodiment, four pairs of the row of first pressure chambers 32*a* and the row of second pressure chambers 32*b* are provided in one head 11, and four sets of manifolds (each set including the first manifold 61, the second manifold 62, and the common manifold 63) are provided correspondingly. Each one set of manifolds 61, 62, 63 is connected to the identical sub-tank 16*a*. In this connection, a flow path 33 connected to the identical sub-tank 16*a* includes a first communication passage in communication with the first pressure chamber 31*a* and a second communication passage in communication with the second pressure chamber 31*b*.

Specifically, the first communication passage includes the common manifold 63, the first communication passage 51, the second communication passage 52, and the first manifold 61, and is fluidly connected to the first pressure chamber 31*a* such that the liquid flows in the order of the common manifold 63, the first communication passage 51, the first pressure chamber 31*a*, the second communication passage 52, and the first manifold 61. Further, the second communication passage includes the common manifold 63, the third communication passage 53, the fourth communication passage 54, and the second manifold 62, and is fluidly connected to the second pressure chamber 31*b* such that the liquid flows in the order of the common manifold 63, the third communication passage 53, the second pressure chamber 31*b*, the fourth communication passage 54, and the second manifold 62.

The common manifold 63 is common to the first and second communication passages of the flow path 33. In other words, the first communication passage 51 and the third communication passage 53 are branched from the common manifold 63. A liquid circulation passage including the flow path 33, the first pressure chamber 31*a*, and the second pressure chamber 31*b* is connected to the sub-tank 16*a*. Specifically, the circulation passage includes a first circulation passage for the circulation of liquid through the sub-tank 16*a*, the first communication passage, and the first pressure chamber 31*a*, and a second circulation passage for the circulation of liquid through the sub-tank 16*a*, the second communication passage, and the second pressure chamber 31*b*.

Figure 2:
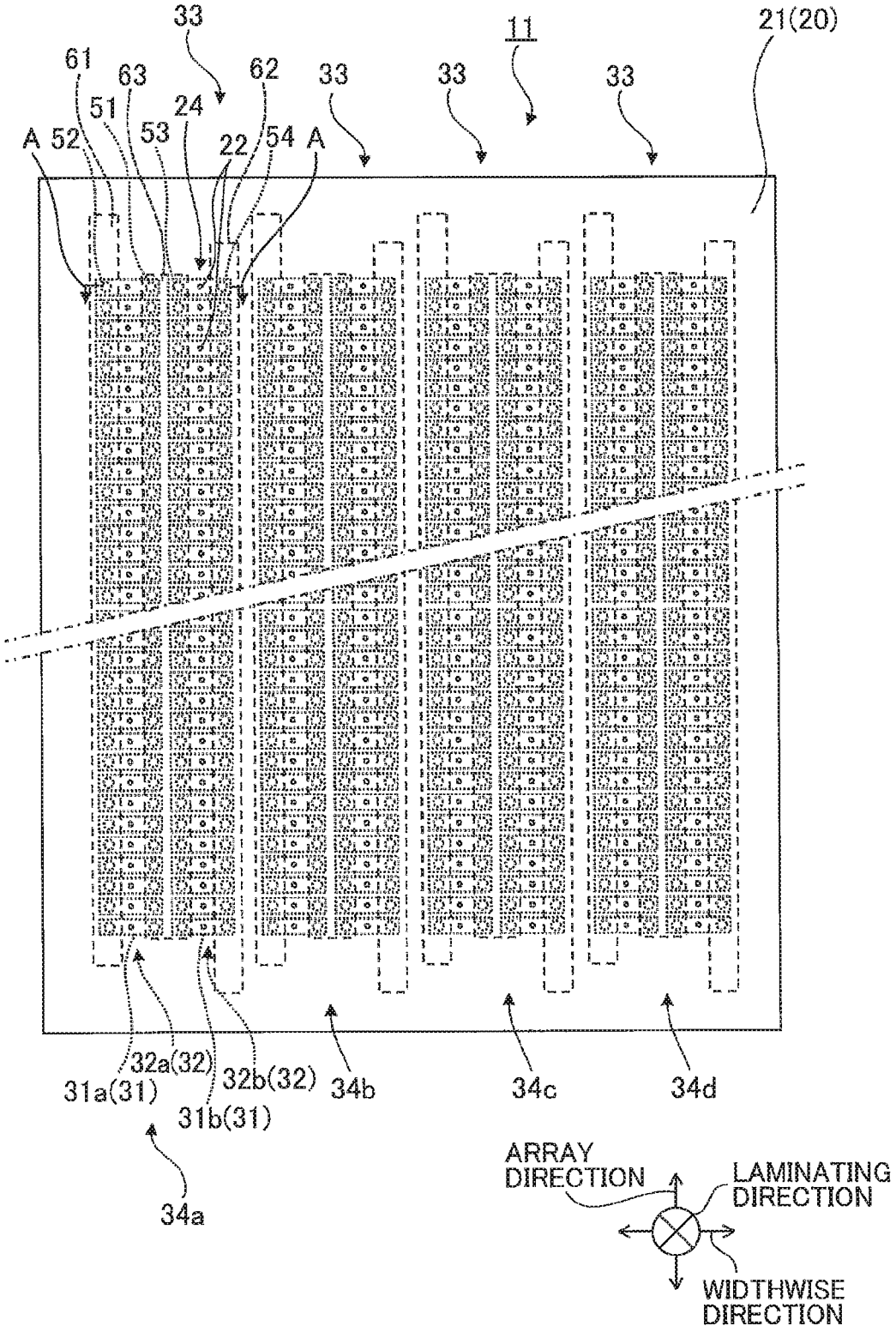
FIG. 2 is a plan view of the head, and particularly illustrating an ejection surface of the head.

More specifically, as illustrated in FIG. 2, the head 11 is formed with a plurality of (four in this embodiment) liquid circulation passages including a first liquid circulation passage 34*a*, a second liquid circulation passage 34*b*, a third liquid circulation passage 34*c*, and a fourth liquid circulation passage 34*d* for four kinds of liquids. That is, a first liquid flows through the first liquid circulation passage 34*a*, a second liquid flows through the second liquid circulation passage 34*b*, a third liquid flows through the third liquid circulation passage 34*c*, and a fourth liquid flows through the fourth liquid circulation passage 34*d*.

The tank 16 is provided for each of the liquid circulation passages 34*a*-34*d*, and each liquid circulation passage is connected to each tank 16 independent of each other. Each liquid circulation passage includes the first manifold 61, the second manifold 62 and the common manifold 63. The first manifold 61, the common manifold 63, and the second manifold 62 of the first liquid circulation passage 34*a* and the first manifold 61, the common manifold 63, and the second manifold 62 of the second liquid circulation passage 34*b* are in parallel to each other, and are arrayed in the widthwise direction in this order.

Hence, the second manifold 62 of the first liquid circulation passage 34*a* and the first manifold 61 of the second liquid circulation passage 34*b* extend parallel to each other and are positioned side by side. Incidentally, description of the third and fourth liquid circulation passages 34*c* and 34*d* will be omitted, since the structure or layout of the third liquid circulation passages 34*c* and 34*d* is the same as the first and second liquid circulation passages 34*a*, and 34*b*.

In the liquid circulation passage, the first manifold 61 functions as a return manifold for returning the liquid from the first pressure chamber 31*a* to the sub-tank 16 through the second communication passage 52, and the second manifold 62 functions as a return manifold for returning the liquid from the second pressure chamber 31*b* to the sub-tank 16 through the fourth communication passage 54.

Further, the common manifold 63 functions as a supply manifold for supplying the liquid from the sub-tank 16 to the first pressure chamber 31*a* through the first communication passage 51, and to the second pressure chamber 31*b* through the third communication passage 53. Thus, the common manifold 63 positioned in the widthwise direction between the row of first pressure chambers 32*a* and the row of second pressure chambers 32*b* is common to the row of first pressure chambers 32*a* for the first pressure chamber 31*a* and the row of second pressure chambers 32*b* for the second pressure chamber 31*b*. Thus, the dimension of the common manifold 63 in the widthwise direction can be set small.

Here, inflow of the liquid from the first pressure chamber 31*a* and the second pressure chamber 31*b* into the first manifold 61 and the second manifold 62 can restrain increase in size of air bubbles contained in the liquid, in comparison with inflow of the liquid from the first pressure chamber 31*a* and the second pressure chamber 31*b* into the single common manifold 63.

In the head 11, the liquid circulation passage including the first pressure chamber 31*a*, the second pressure chamber 31*b* and the flow path 33 is provided for each of the sub-tanks 16*a*, i.e., for each kinds of liquids. The plurality of liquid circulation passages are independent of each other, so that mixture of the liquid does not occur between the liquid flowing through one liquid circulation passage and the liquid flowing through other liquid circulation passage thereby avoiding mixing of colors.

Figure 3:
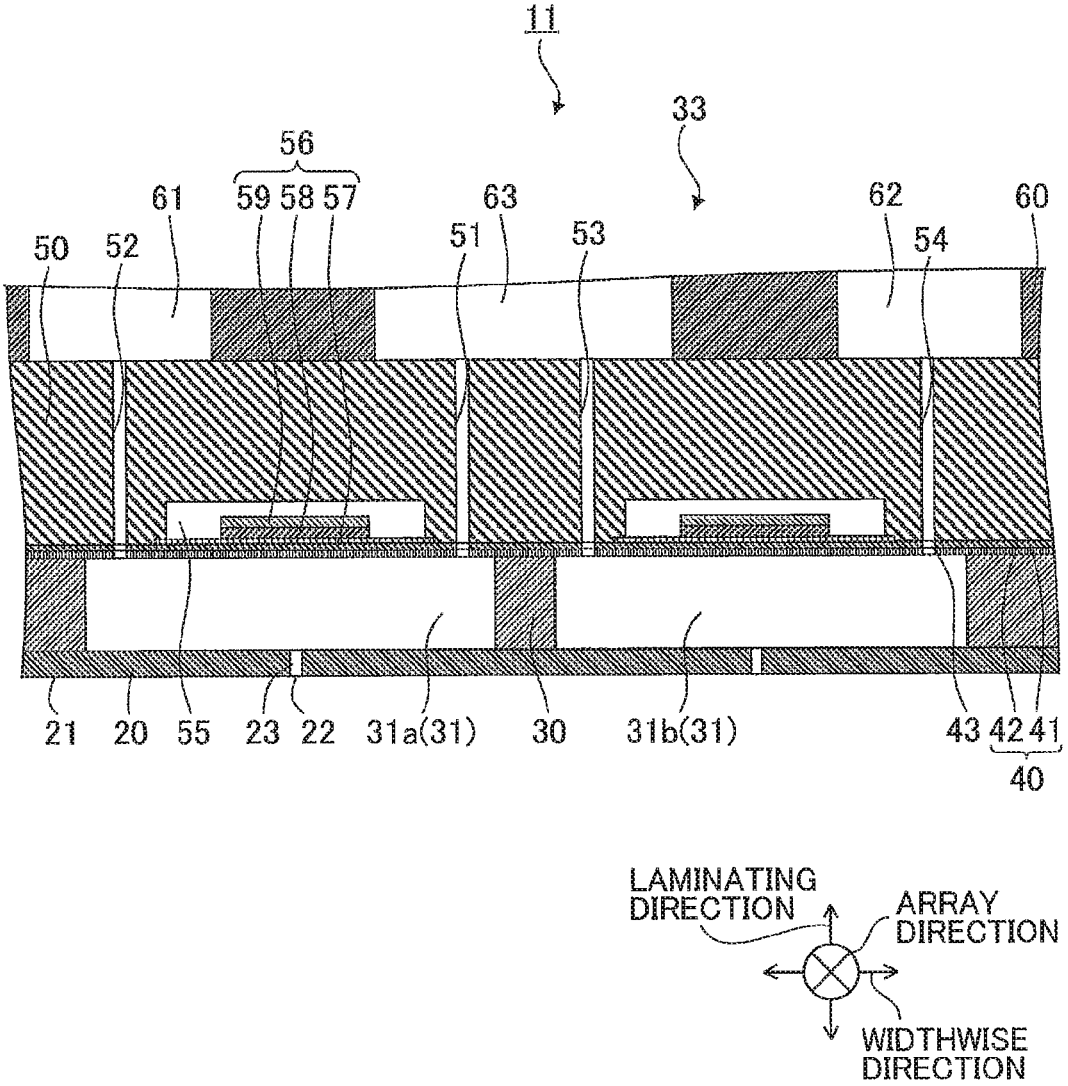
FIG. 3 is an enlarged cross-sectional view of the head taken along the line A-A in FIG. 2.

As illustrated in FIG. 3, in the flow path 33, the common manifold 63 has a cross-sectional area taken along a plane perpendicular to the longitudinal direction thereof is greater than each of the cross-sectional areas of the first manifold 61 and the second manifold 62.

In the flow path 33, the first manifold 61 and the second manifold 62 are provided with respect to the one common manifold 63. Therefore, amount of liquid flowing through each of the first manifold 61 and the second manifold 62 is half of amount of liquid flowing through the common manifold 63. With this structure, the first manifold 61 and the second manifold 62 can has a dimension smaller than that of the common manifold 63, thereby making the head 11 compact.

The cross-sectional area of the common manifold 63 is 1.6 times as large as the cross-sectional area of the first manifold 61 and the cross-sectional area of the second manifold 62. Thus, amount of liquid flowing through the common manifold 63 is greater than that flowing through each of the first manifold 61 and the second manifold 62. Here, passage resistance in the common manifold 63 can be equal to or approximately equal to the passage resistance in the first manifold 61 and the second manifold 62. Thus, smooth flow of the liquid is realized in the flow path 33.

Further, the first manifold 61 has a length in the array direction equal to that of the second manifold 62. Here amount of liquid flowing through the first manifold 61 is equal to that flowing through the second manifold 62 as long as the cross-sectional area of the first manifold 61 is equal to that of the second manifold 62.

Incidentally, the common manifold 63 may function as the return manifold, and the first manifold 61 and the second manifold 62 may function as the supply manifolds. In this case, the first communication passage 51 and the third communication passage 53 are the return passages, and the second communication passage 52 and the fourth communication passage 54 are the supply passages.

[Modification to First Embodiment]

According to the first embodiment, in all of the plurality of the liquid circulation passages, all of the first manifolds 61 and the second manifolds 62 are the return manifolds and all of the common manifolds 63 are the supply manifolds, or all of the first manifolds 61 and the second manifolds 62 are the supply manifolds and all of the common manifolds 63 are the return manifolds. In contrast, as a modification, replacement of the supply manifold by the return manifold and vice versa may be made with respect to each of the plurality of the liquid circulation passages.

For example, according to the first embodiment, the first manifold 61 and the second manifold 62 of the first liquid circulation passage 34*a* are the return manifolds, and the first manifold 61 and the second manifold 62 of the second liquid circulation passage 34*b* are also the return manifolds. On the other hand, according to the modification, the first manifold 61 and the second manifold 62 of the first liquid circulation passage 34*a* are the return manifolds, whereas the first manifold 61 and the second manifold 62 of the second liquid circulation passage 34*b* are the supply manifolds. Therefore, in the modification, the first liquid flows through the second manifold 62 of the first liquid circulation passage 34*a* from the row of second pressure chambers 32*b* toward the sub-tank 16*a*, whereas the second liquid inflows through the first manifold 61 of the second liquid circulation passage 34*b* from the sub-tank 16*a* toward the row of first pressure chambers 32*a*.

Here, a heater (not illustrated) is disposed at each sub-tank 16*a* or at a position between the sub-tank 16*a* and each manifold for heating the liquid to be supplied to each pressure chamber. In the first liquid circulation passage 34*a*, the heated liquid flows through the common manifold 63, and then flows through the first manifold 61 and the second manifold 62. On the other hand, in the second liquid circulation passage 34*b*, the heated liquid flows through the first manifold 61 and the second manifold 62, and then flows through the common manifold 63.

Temperature of the liquid is lowered toward downstream of the circulation passage. Accordingly, the temperature of the second liquid flowing through the first manifold 61 of the second liquid circulation passage 34*b* is higher than the temperature of the first liquid flowing through the second manifold 62 of the first liquid circulation passage 34*a*. In this way, since the temperature of the liquids flowing through the neighboring manifolds 61 and the 62 is different from each other, heat exchange occurs between neighboring liquids, thereby uniformizing the temperature of the liquids.

Second Embodiment

Figure 4:
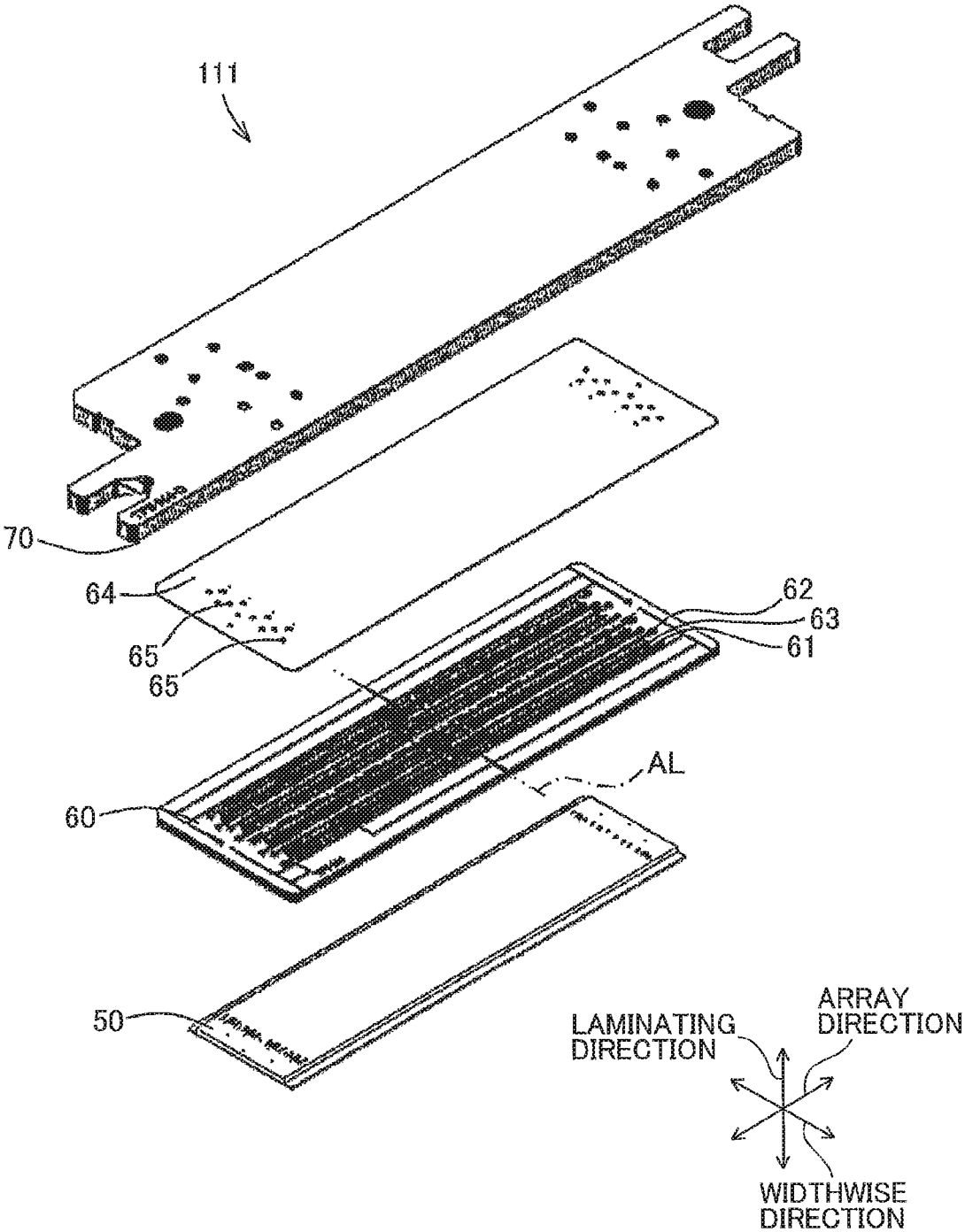
FIG. 4 is an exploded perspective view of a head according to a second embodiment.
Figure 5:
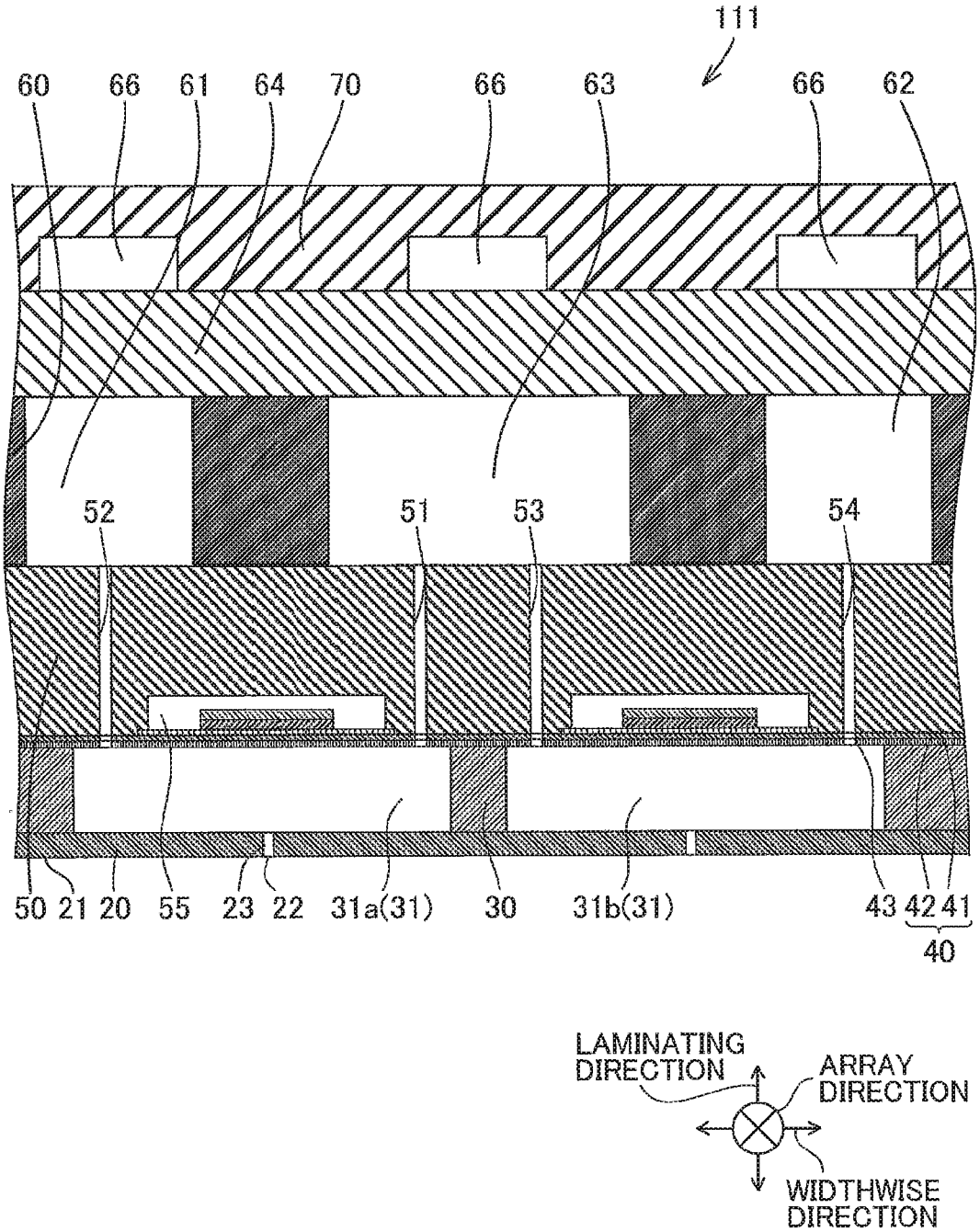
FIG. 5 is an enlarged cross-sectional view of the head according to the second embodiment taken along the line corresponding to the line A-A in FIG. 2.

A head 111 according to a second embodiment will be described with reference to FIGS. 4 and 5, wherein like parts and components are designated by the same reference numerals as those shown in the first embodiment to avoid duplicating description. The head 111 further includes a damper plate 64 and a second plate 70.

The damper plate 64 is laminated on an upper surface of the first plate 60, and the second plate 70 is laminated on an upper surface of the damper plate 64. These are bonded together by an adhesive agent. Alternatively, the damper plate 64 may be integral with the first plate 60. In the latter case, a lower surface of a first plate 60 made from metal such as SUS is subjected to half etching to form the manifolds 61, 62, 63. An upper portion of the metal plate remaining on each upper end of each manifold functions as the damper plate 64.

The damper plate 64 is a single layer such as a resin layer and a metal layer made from polyimide resin and SUS. Alternatively, the damper plate 64 may be in a form of a plurality of layers including resin layers and/or metal layers. The damper plate 64 is a flat plate shaped and is elastically deformable. The damper plate 64 has a thickness smaller than that of the first plate 60 and the second plate 70. The damper plate 64 covers the upper surface of the first plate 60, and closes the upper openings of the manifolds 61, 62, 63 in the laminating direction.

The damper plate 64 has each end portion in its longitudinal direction (the array direction) formed with a plurality of (twelve) bores 65. The bores 65 are through-holes extending through the thickness of the damper plate 64. Each set of three bores are in communication with each set of manifolds 61, 62, 63 at the end portion in the array direction of the damper plate 64 (FIG. 4).

The second plate 70 is a flat plate whose lower surface faces the damper plate 64. Damper grooves 66 are formed at the lower surface. The damper grooves 66 are formed by for example half-etching the second plate 70 such that the damper grooves 66 are recessed upward from the lower surface. Thus, the damper grooves 66 are open downward. The damper grooves 66 are positioned between in the array direction the pair of bores 65 of the damper plate 64. That is, the damper grooves 66 do not extend to a distal end in the array direction of the second plate 70. The lower opening of the damper grooves 66 are covered by the damper plate 64. Thus, the damper grooves 66 are blocked against the manifolds 61, 62, 63.

Figure 6A:
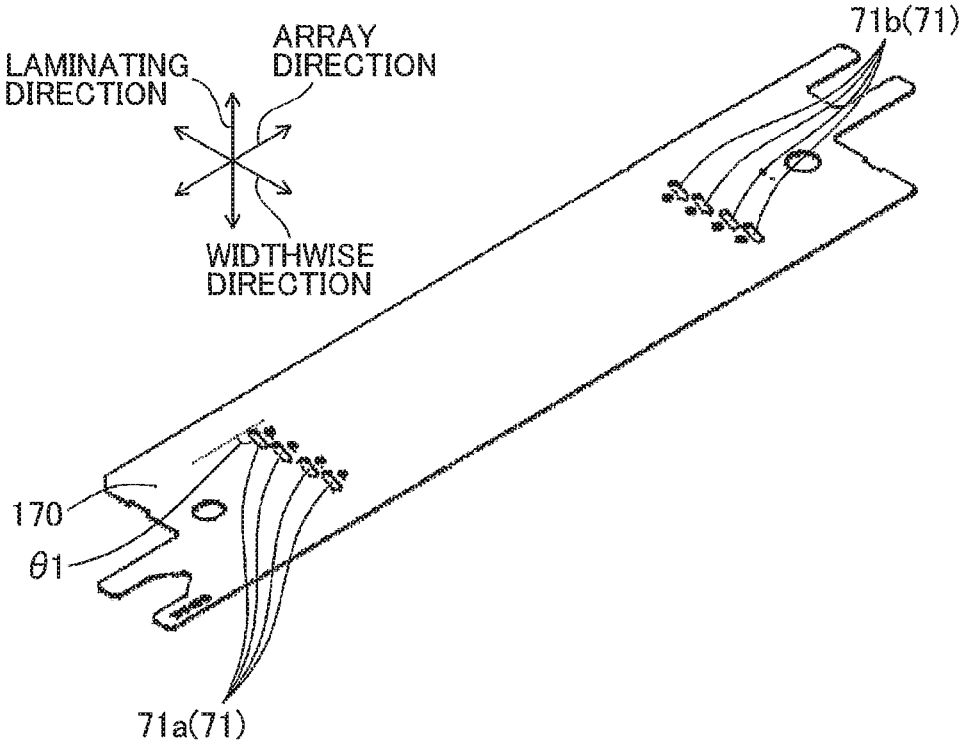
FIG. 6A is a perspective view of a second plate in a head according to a third embodiment as viewed from above in a laminating direction.
Figure 6B:
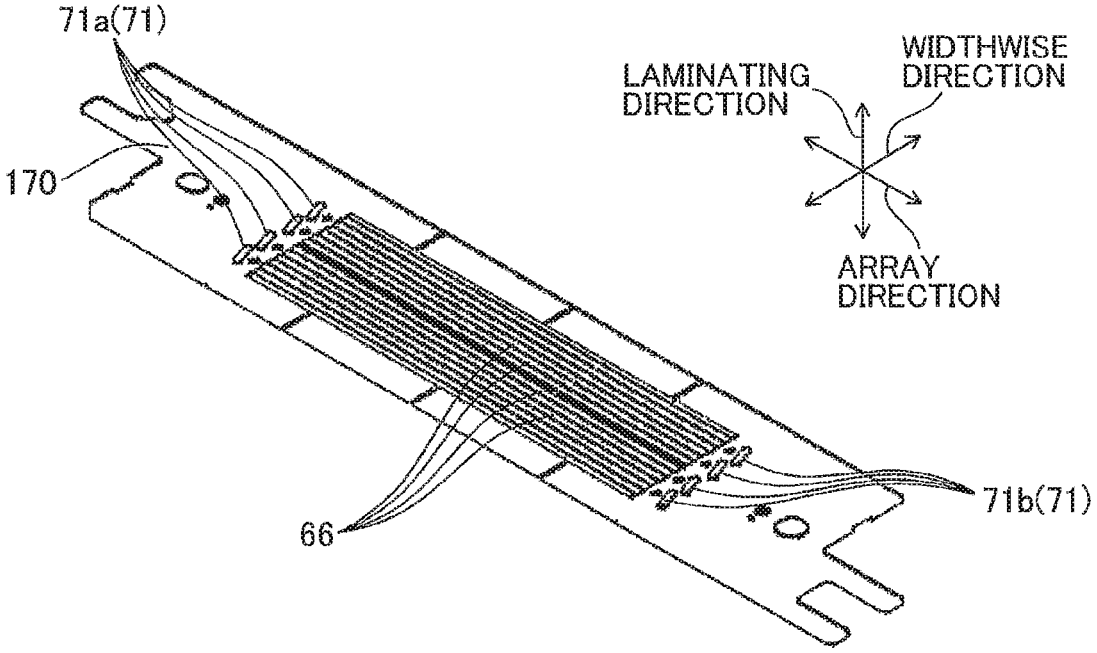
FIG. 6B is a perspective view of the second plate in the head according to the third embodiment as viewed from below in the laminating direction.

The damper grooves 66 extend in the array direction, and are positioned to overlap with the return manifold through the damper plate 64 in the laminating direction. For example, in a case where the first manifold 61 and the second manifold 62 are return manifolds, the damper grooves 66 are positioned to align with the first manifold 61 and the second manifold 62 in the laminating direction. The damper grooves 66 per se are illustrated in FIG. 6B.

Since the damper plate 64 is positioned between the damper grooves 66 and the first and second manifolds 61, 62, the damper plate 64 is deformable by the pressure fluctuation of the fluid flowing through the first and second manifolds 61, 62. Thus, pressure fluctuation of the liquid can be attenuated. The bore 65 connected to the first and second manifolds 61, 62 and the common manifold 63 are directly or indirectly connected to the tank 16.

Third Embodiment

Figure 7:
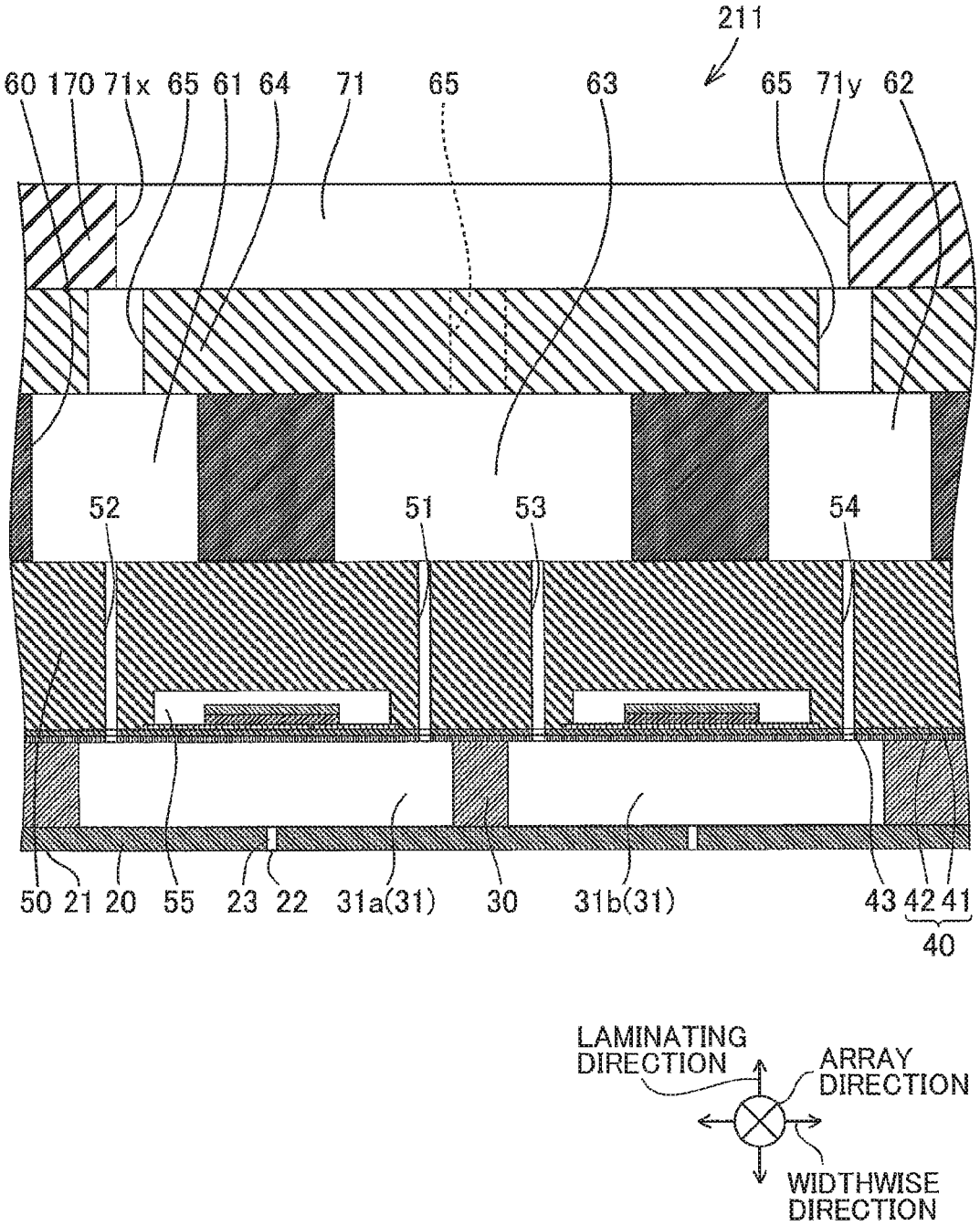
FIG. 7 is an enlarged cross-sectional view of the head according to the third embodiment taken along the line corresponding to the line A-A in FIG. 2.

A head 211 according to a third embodiment will next be described with reference to FIGS. 6A through 7. The third embodiment is the same as the second embodiment except for a second plate 170 corresponding to the second plate 70 of the second embodiment. According to the third embodiment the flow path 33 further includes a joining passage 71 fluidly connected to the first manifold 61 and the second manifold 62.

Specifically, the second plate 170 is formed with a plurality of joining passages 71*s* each connecting each first manifold 61 and each second manifold 62 together. Each joining passage 71 is positioned to overlap with each first manifold 61 and each second manifold 62 in the laminating direction, and extends through a thickness of the second plate 170 in the laminating direction. Hence, each lower open end of each joining passage 71 is connected to each first manifold 61 and each second manifold 62 thereby connecting each first manifold 61 to each second manifold 62.

The joining passage 71 is positioned opposite to the second communication passage 52 with respect to the first manifold 61. The joining passage 71 is positioned above the first manifold 61. Further, the joining passage 71 is positioned opposite to the fourth communication passage 54 with respect to the second manifold 62. The joining passage 71 is positioned above the second manifold 62.

As described above, since the joining passage 71 is overlapped with the first manifold 61 and the second manifold 62 in the laminating direction, the flow path 33 extends in the laminating direction from the first and second manifolds 61, 62 to the joining passage 71. Thus, the joining passage 71 can be provided without an increase in size of the head 211 in a direction perpendicular to the laminating direction.

Further, the joining passage 71 is a slot like configuration having a rectangular cross-sectional shape taken along a plane perpendicular to the laminating direction. That is, the joining passage 71 is elongated so as to span between the first manifold 61 and the second manifold 62. The joining passage 71 has one end 71*x* and another end 71*y* in its longitudinal direction. As illustrated in FIG. 7, the one end 71*x* is not positioned farther from the fourth communication passage 54 than the second communication passage 52 is from the fourth communication passage 54 in the widthwise direction, and the other end 71*y* is not positioned farther from the second communication passage 52 than the fourth communication passage 54 is from the second communication passage 52 in the widthwise direction. In other words, the one end 71*x* is positioned in alignment with the open end of the second communication passage 52 and the other end 71*y* is positioned in alignment with the open end of the fourth communication passage 54.

With this structure, in the longitudinal direction of the joining passage 71, the joining passage 71 does not extend to exceed the first manifold 61 in a direction away from the second manifold 62, and does not extend to exceed the second manifold 62 in a direction away from the first manifold 61. In other words, the joining passage 71 is positioned on the first manifold 61, and on the second manifold 62, and at a position between the first manifold 61 and the second manifold 62. Hence, the liquid can flow through the first manifold 61, the second manifold 62 and the joining passage 71 without any congestion of the liquid.

More specifically, the joining passage 71 includes a first joining passage 71*a* and a second joining passage 71*b*. One end in the longitudinal direction (array direction) of the first manifold 61 and one end in the longitudinal direction (array direction) of the second manifold 62 are connected to each other by the first joining passage 71*a*. Another end in the longitudinal direction (array direction) of the first manifold 61 and another end in the longitudinal direction (array direction) of the second manifold 62 are connected to each other by the second joining passage 71*b*. Thus, the first joining passage 71*a* and the second joining passage 71*b* are away from each other in the array direction.

The liquid flows through the first manifold 61 and the second manifold 62 in the array direction. Therefore, each end in the array direction of the first manifold 61 and the second manifold 62 functions as a downstream end. Since the first joining passage 71*a* and the second joining passage 71*b* are connected to each of the downstream ends, the liquid that has been flowed through the first manifold 61 and the second manifold 62 can smoothly flow through the joining passage 71.

Further, each of the first joining passage 71*a* and the second joining passage 71*b* is connected to the first manifold 61 and the second manifold 62 through the bore 65 of the damper plate 64 at each end portion in the array direction of the damper plate 64. The damper grooves 66 are formed in the second plate 170 at a position between the first joining passage 71*a* and the second joining passage 71*b* in the array direction. As described above, the damper grooves 66 restrains pressure fluctuation of the liquid flowing through the first manifold 61 and the second manifold 62.

Here, the positions of first manifold 61 and the second manifold 62 are different from each other in the array direction, and the length of the first manifold 61 is equal to the length of the second manifold 62. Specifically, the one end in the array direction of the second manifold 62 is positioned farther from one end in the array direction of the 170 than the one end in the array direction of the first manifold 61 is. Thus, the one end of the first manifold 61 is not aligned with the one end of the second manifold 62 in the array direction. Further, the other end in the array direction of the second manifold 62 is positioned closer to another end in the array direction of the 170 than another end in the array direction of the first manifold 61 is. Thus, the other end of the first manifold 61 is not aligned with the other end of the second manifold 62 in the array direction.

With this arrangement, the first joining passage 71*a* and the second joining passage 71*b* extend obliquely by an angle θ1 with respect to the array direction. Further, neighboring first joining passages 71*a* extend in parallel to each other with a space therebetween in the widthwise direction, and neighboring second joining passages 71*b* extend in parallel to each other with a space therebetween in the widthwise direction. Because of the oblique orientation of the joining passages 71, larger space between the neighboring first joining passages 71*a* and larger space between the neighboring second joining passages 71*b* can be provided in comparison with a case where the first joining passage 71*a* and the second joining passage 71*b* extend perpendicular to the array direction.

The angle θ1 is greater than zero, and smaller than 90 degrees. Preferably, the angle θ1 is equal to or greater than 45 degrees, and less than 90 degrees, for example, 70 degrees. The first joining passage 71*a* and the second joining passage 71*b* can connect the first manifold 61 to the second manifold 62 by setting the angle θ1 greater than zero.

Further, if the interval in the widthwise direction between the neighboring first and second manifolds 61 and 62 is small, an interval between an end portion of each first joining passage 71*a* and second joining passage 71*b* connected to the first manifold 61 and an end portion of each first joining passage 71*a* and second joining passage 71*b* connected to the second manifold 62 is narrow. Hence, leakage of liquid flowing through the first joining passage 71*a* and the second joining passage 71*b* may occur.

On the other hand, the head becomes bulky if the interval in the widthwise direction between the neighboring first and second manifolds 61 and 62 is large. Further, the plurality of the first joining passages 71*a* and second joining passages 71*b* extend in the widthwise direction if the angle θ1 is set to 90 degrees, causing an increase in size of the head. In contrast, by setting the angle θ1 smaller than 90 degrees, each neighboring end portions of each first joining passage 71*a* and second joining passage 71*b* can be displaced from each other in the array direction. Accordingly, large interval between neighboring first joining passages 71*a* and second joining passages 71*b* can be obtained without increase in the interval between neighboring first and second manifolds 61 and 62.

Further, the common manifold 63 has a length in the array direction smaller than that of the first manifold 61 and the second manifold 62. One end in the array direction of the common manifold 63 is positioned farther from the one end in the array direction of the second plate 170 than the each one end in the array direction of the first manifold 61 and the second manifold 62 is, and another end in the array direction of the common manifold 63 is positioned farther from the other end in the array direction of the second plate 170 than the each other end in the array direction of the first manifold 61 and the second manifold 62 is.

With this arrangement, the common manifold 63 is not overlapped with the first joining passage 71*a* and the second joining passage 71*b* in the laminating direction. Therefore, the common manifold 63 can be arranged between the first manifold 61 and the second manifold 62 without any interference with the first joining passage 71*a* and the second joining passage 71*b*. The first joining passage 71*a* and the second joining passage 71*b*, and the bore 65 connected to the first and second manifolds 61, 62 and the common manifold 63 are directly or indirectly connected to the tank 16.

Fourth Embodiment

Figure 8:
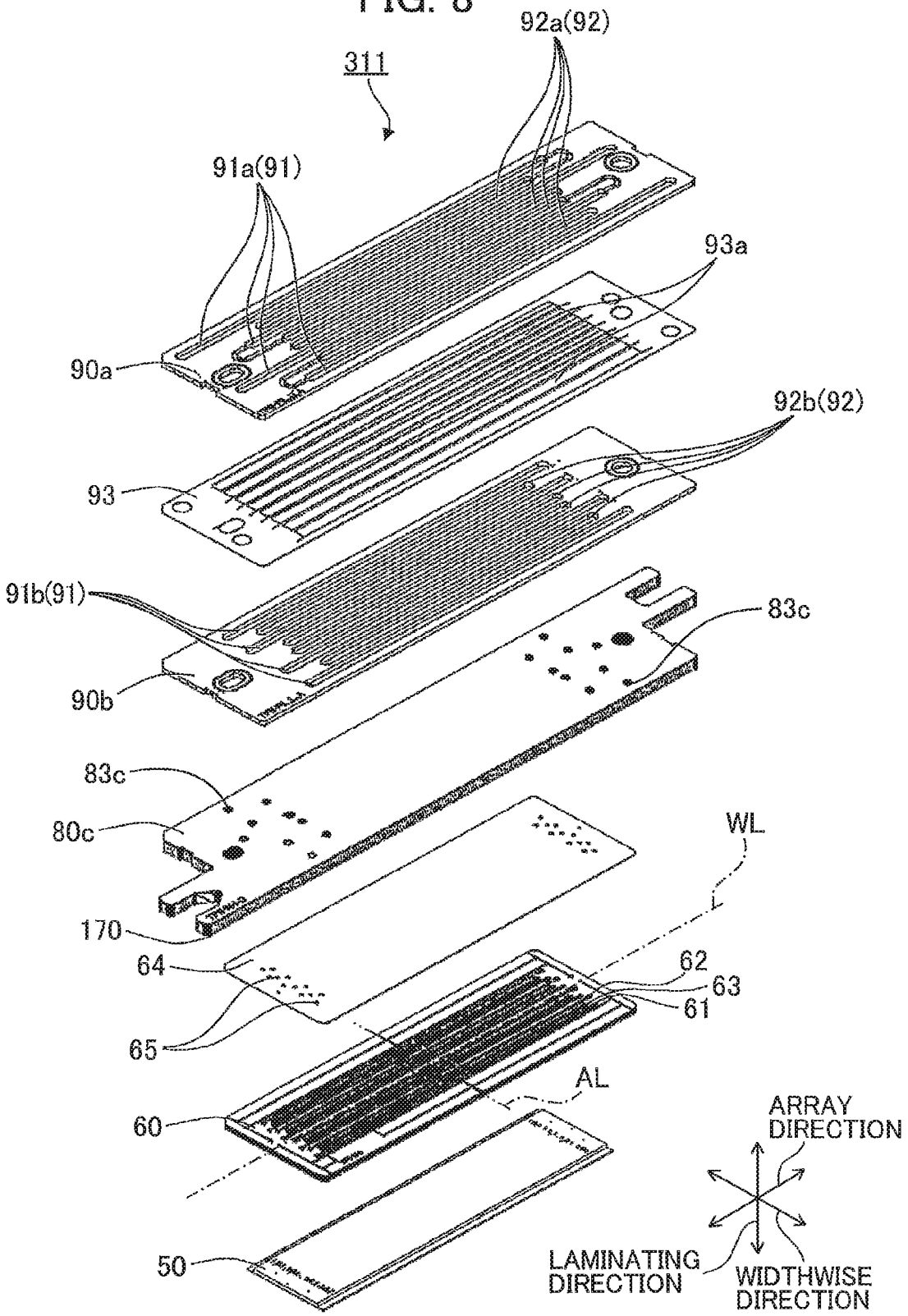
FIG. 8 is an exploded perspective view of a head according to a fourth embodiment.

A head 311 according to a fourth embodiment will next be described with reference to FIGS. 8 through 10, wherein like parts and components are designated by the same reference numerals as those shown in the foregoing embodiments. The fourth embodiment is the same as the third embodiment except that the flow path 33 of the fourth embodiment further includes a first connection passage 81, a second connection passage 82, a first reservoir passage 91, and a second reservoir passage 92.

The fourth embodiment further includes a reservoir plate including a first reservoir plate 90*a* and a second reservoir plate 90*b*, a connection plate including a first connection plate 80*a*, a second connection plate 80*b*, and a third connection plate 80*c*, and a filter plate 93 for providing the flow path 33. The first reservoir passage 91 and the second reservoir passage 92 are formed in the first reservoir plate 90*a* and in the second reservoir plate 90*b*. The first connection passage 81 is formed in the first connection plate 80*a*, the second connection plate 80*b*, and the third connection plate 80*c*. The second connection passage 82 is formed in the second plate 170, the first connection plate 80*a*, the second connection plate 80*b*, and the third connection plate 80*c*. The filter plate 93 is positioned between the first reservoir plate 90*a* and the second reservoir plate 90*b* in the laminating direction.

These plates are flat plate shaped, and the first connection plate 80*a*, the second connection plate 80*b*, the third connection plate 80*c*, the second reservoir plate 90*b*, the filter plate 93, and the first reservoir plate 90*a* are laminated in this order on the second plate 170, and are bonded together by an adhesive agent.

The first reservoir passage 91 and the second reservoir passage 92 extends in the array direction, and are spaced away from each other in the widthwise direction. The first reservoir passage 91 is in communication with the first manifold 61 and the second manifold 62 through the first connection passage 81 and the joining passage 71. The second reservoir passage 92 is in communication with the common manifold 63 through the second connection passage 82. Since the first manifold 61 and the second manifold 62 are connected together by the joining passage 71, four first reservoir passages 91 are formed in the first reservoir plate 90*a* for the eight first and second manifolds 61 and 62, and four second reservoir passages 92 are formed for the four third manifolds 63.

Each first reservoir passage 91 and second reservoir passage 92 penetrate the first reservoir plate 90*a* and the second reservoir plate 90*b* in the laminating direction. Lower open ends of the first reservoir passage 91 and the second reservoir passage 92 are covered by the third connection plate 80*c*. The first reservoir passage 91 includes a first reservoir passage 91*a* formed in the first reservoir plate 90*a* and a first reservoir passage 91*b* formed in the second reservoir plate 90*b*, and the second reservoir passage 92 includes a second reservoir passage 92*a* formed in the first reservoir plate 90*a* and a second reservoir passage 92*b* formed in the second reservoir plate 90*b*. Further, a filter 93*a* is formed on the filter plate 93.

The first reservoir passage 91*a*, the filter 93*a*, and the first reservoir passage 91*b* are overlapped with each other in the laminating direction. The first reservoir passage 91*a* and the first reservoir passage 91*b* forms the first reservoir passage 91 which is in communication with the tank 16.

The second reservoir passage 92*a*, the filter 93*a* provided in the filter plate 93, and the second reservoir passage 92*b* are overlapped with each other in the laminating direction. The second reservoir passage 92*a* and the second reservoir passage 92*b* forms the second reservoir passage 92 which is in communication with the tank 16.

The filter 93*a* covers the lower open end of the first reservoir passage 91*a*, and covers the upper open end of the first reservoir passage 91*b*. The filter 93*a* also covers the lower open end of the second reservoir passage 92*a*, and covers the upper open end of the second reservoir passage 92*b*. Therefore, impurities contained in the liquid can be trapped by the filter 93*a* when the liquid flowing through the first reservoir passage 91 and the second reservoir passage 92 passes through the filter 93*a*.

The first connection passage 81 is connected to the joining passage 71 and the first reservoir passage 91. The first connection passage 81 includes a pair of first parts 83 positioned away from each other in the array direction. Each first part 83 includes four first holes 83*a*, four second holes 83*b* and four third holes 83*c*.

Each first hole 83*a* extends through a thickness of the first connection plate 80*a* in the laminating direction at a position overlapping with each first joining passage 71*a* (or second joining passage 71*b*). The first hole 83*a* has a circular cross-section taken along a plane perpendicular to the laminating direction. The four first holes 83*a* are arrayed in the widthwise direction with an interval between neighboring first holes 83*a*.

Each first hole 83*a* is connected to an intermediate position of each first joining passage 71*a* (or second joining passage 71*b*). Specifically, the intermediate position is a center in a lengthwise direction of each first joining passage 71*a* (or second joining passage 71*b*), and the lengthwise direction is defined between one end of the first joining passage 71*a* (or second joining passage 71*b*) connected to the first manifold 61 and another end connected to the second manifold 62. In this connection, amount of liquid flowing from the first manifold 61 into the first hole 83*a* through the first joining passage 71*a* (or second joining passage 71*b*) can be equal to or close to amount of liquid flowing from the second manifold 62 into the first hole 83*a* through the first joining passage 71*a* (or second joining passage 71*b*).

Each second hole 83*b* extends through a thickness of the second connection plate 80*b* in the laminating direction at a position overlapping with each first hole 83*a*. The second hole 83*b* has an oblong cross-sectional shape taken along a plane perpendicular to the laminating direction. Hence, the second hole 83*b* has a lower open end connected to an upper open end of the first hole 83*a*.

Each third hole 83*c* extends through a thickness of the third connection plate 80*c* in the laminating direction at a position overlapping with each second hole 83*b*. The third hole 83*c* has a circular cross-section taken along a plane perpendicular to the laminating direction. The third hole 83*c* has a lower open end connected to an upper open end of the second hole 83*b*. Further, each third hole 83*c* is overlapped with, in the laminating direction, one end portion in the array direction of each first reservoir passage 91. Thus, an upper open end of each third hole 83*c* is connected to a lower open end of the first reservoir passage 91. The four third holes 83*c* are arrayed in the widthwise direction with an interval between neighboring third holes 83*c*.

Hence, each first joining passage 71*a* and second joining passage 71*b* is connected to each first reservoir passage 91 through each first connection passage 81 including the first hole 83*a*, the second hole 83*b*, and the third hole 83*c*. The second hole 83*b* has one end portion in its lengthwise direction connected to the first hole 83*a* and another end portion in the lengthwise direction connected to the third hole 83*c*. The lengthwise direction is slanted with respect to the widthwise direction and the array direction in a direction from the first hole 83*a* toward the third hole 83*c*.

Figure 9:
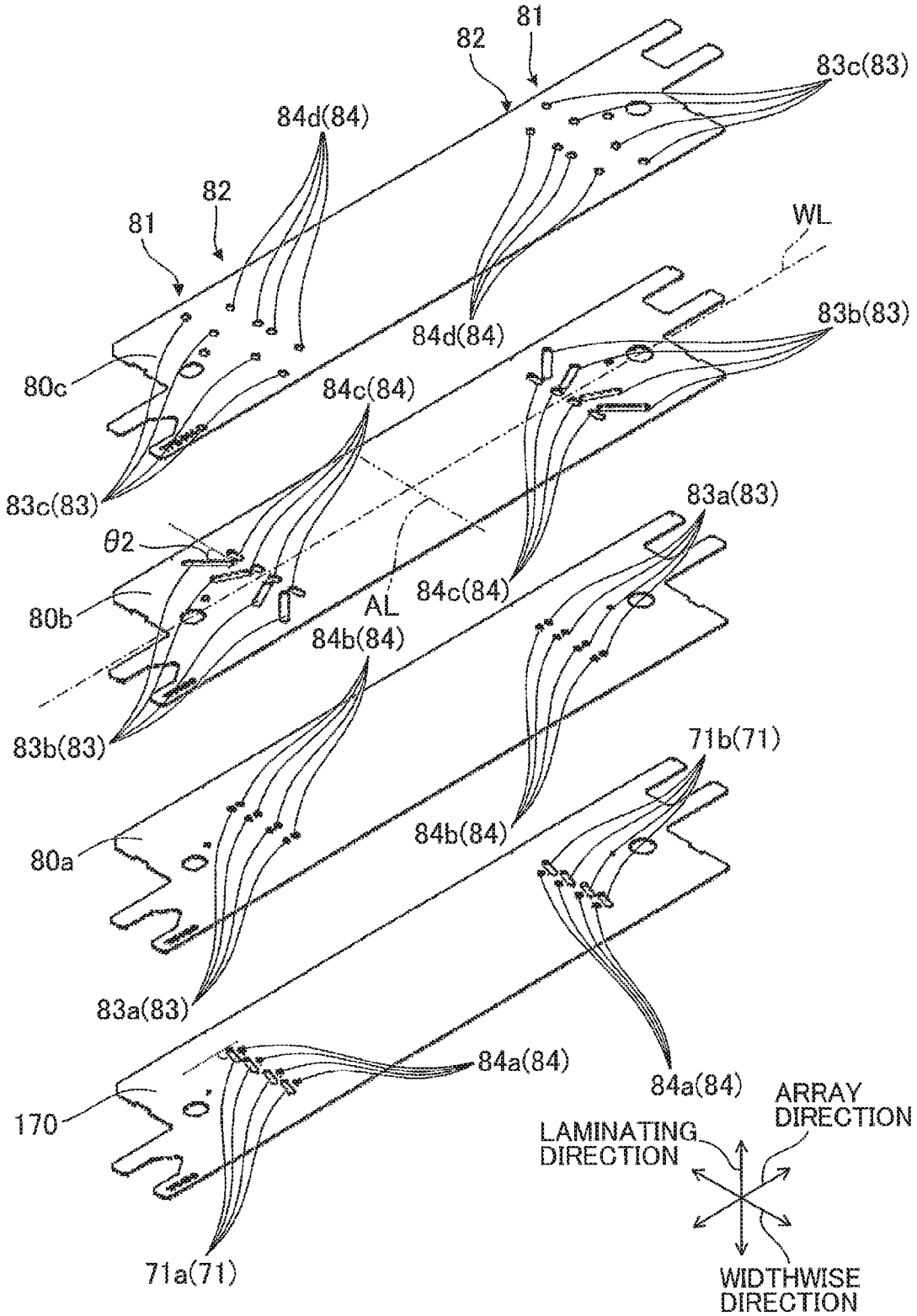
FIG. 9 is a perspective view illustrating, as viewed from above in a laminating direction, a second plate, a first connection plate, a second connection plate, and a third connection plate in the head according to the fourth embodiment.
Figure 10:
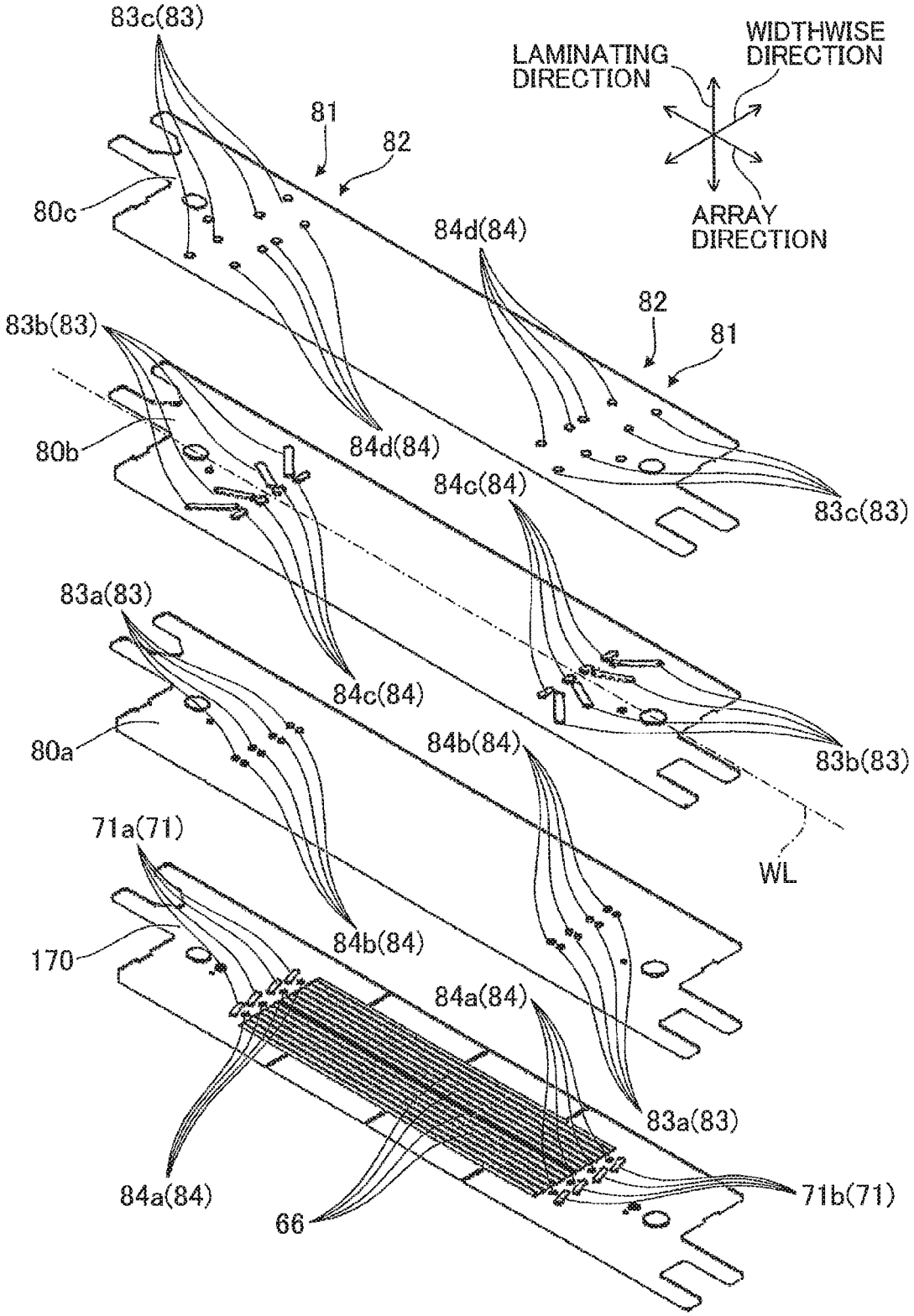
FIG. 10 is a perspective view illustrating, as viewed from below in the laminating direction, the second plate, the first connection plate, the second connection plate, and the third connection plate in the head according to the fourth embodiment.

In FIG. 9, an imaginary line AL is illustrated. The line AL extends in the widthwise direction at a center in the array direction of the twelve manifolds 61, 62, 63. Each second hole 83*b* obliquely extends with respect to the line AL such that the other end portion (connected to the third hole 83*c*) is positioned farther from the line AL than the one end portion (connected to the first hole 83*a*) is from the line AL. Further, the four second holes 83*b* arrayed in the widthwise direction have length in the array direction equal to each other.

Thus, the length of the first reservoir passage 91 connected to the other end portion of the second hole 83*b* through the third hole 83*c* is greater than the length of the first manifold 61 and the second manifold 62 connected to the one end portion of the second hole 83*b* through the first joining passage 71*a* (second joining passage 71*b*) and the first hole 83*a*.

In FIG. 9, another imaginary line WL is illustrated. The line WL extends in the array direction at a center in the widthwise direction of the twelve manifolds 61, 62, 63. Each second hole 83*b* obliquely extends with respect to the line WL. Inclination of two second holes 83*b* positioned at one side in the widthwise direction of the line WL is opposite to the inclination of the remaining two second holes 83*b* positioned at the other side in the widthwise direction of the line WL such that the other end portion (connected to the third hole 83*c*) of the second hole 83*b* is positioned farther from the line WL than the one end portion (connected to the 83*a*) of the second hole 83*b*.

Further, the second hole 83*b* positioned farther in the widthwise direction from the line WL than the other second hole 83*b* is has a length in the widthwise direction greater than the length of the other third hole 83*c*. Therefore, the second hole 83*b* positioned farther in the widthwise direction from the line WL than the other second hole 83*b* is defines an angle θ2 with respect to the line AL smaller than the angle defined between the other second hole 83*b* and the line AL. For example, the other second hole 83*b* positioned beside the line WL defines the angle θ2 with respect to the line AL of 70 degrees, whereas the second hole 83*b* farthest from the line WL defines the angle θ2 with respect to the line AL of 45 degrees. Hence, interference between neighboring second holes 83*b* is avoidable without increasing in size in the widthwise direction of the head 311 by setting the angle θ2 not less than 45 degrees.

With this arrangement, an interval between neighboring third holes 83*c* in the widthwise direction is greater than an interval between neighboring first holes 83*a*. Thus, the first connection passage 81 extends in a direction away from the line WL as it goes from the first joining passage 71*a* (second joining passage 71*b*) connected to the first part 83*a* toward the first reservoir passage 91 connected to the second hole 83*b* by the formation of the third hole 83*c*.

In this way, the position in the widthwise direction of the first reservoir passage 91 relative to the first manifold 61 and the second manifold 62 can be adjusted by the provision of the first connection passage 81. Accordingly, the size of the first reservoir passage 91 in the widthwise direction and the array direction can be greater than the size of the first manifold 61 and the second manifold 62. As a result, a cross-sectional area of the first reservoir passage 91 can be greater than that of the first manifold 61 and the second manifold 62, so that shortage of the liquid to be supplied to the pressure chamber 31 can be eliminated.

The second connection passage 82 is connected to the second reservoir passage 92 and the common manifold 63. The second connection passage 82 includes a pair of end connection passages 84 positioned away from each other in the array direction. Each end connection passage 84 includes four first bores 84*a*, four second bores 84*b*, four third bores 84*c*, and four fourth bores 84*d*.

Each first bore 84*a* extends through a thickness of the second plate 170 in the laminating direction at a position overlapping with each common manifold 63 to communicate with the common manifold 63. The first bore 84*a* has a circular cross-section taken along a plane perpendicular to the laminating direction. The first bore 84*a* is positioned closer to the line AL than the first joining passage 71*a* (second joining passage 71*b*) is to the line AL in the array direction. Further, the first bore 84*a* is positioned at a center in the widthwise direction of the first joining passage 71*a* (second joining passage 71*b*). The four first bores 84*a* are arrayed in the widthwise direction with an interval between neighboring first bores 84*a*.

Each second bore 84*b* extends through a thickness of the first connection plate 80*a* in the laminating direction at a position overlapping with each first bore 84*a*. The second bore 84*b* has a circular cross-section taken along a plane perpendicular to the laminating direction. The second bore 84*b* is aligned with the first hole 83*a* in the array direction, and is positioned closer to the line AL than the first hole 83*a* is to the line AL.

Each third bore 84*c* extends through a thickness of the second connection plate 80*b* in the laminating direction at a position overlapping with each second bore 84*b* to communicate with the second bore 84*b*. The third bore 84*c* has an oblong cross-sectional shape taken along a plane perpendicular to the laminating direction.

Each fourth bore 84*d* extends through a thickness of the third connection plate 80*c* in the laminating direction at a position overlapping with each third bore 84*c*. The third bore 84*c* has a circular cross-section taken along a plane perpendicular to the laminating direction. The fourth bore 84*d* has a lower open end connected to an upper open end of the third bore 84*c*. Further, the fourth bore 84*d* is positioned to overlap in the laminating direction with an end portion in the array direction of the second reservoir passage 92, and the fourth bore 84*d* has an upper open end connected to a lower open end of the second reservoir passage 92.

The third bore 84*c* extends in the widthwise direction, and has one end portion in the widthwise direction connected to the second bore 84*b*, and another end portion connected to the fourth bore 84*d*. In other words, the third bore 84*c* extends in a direction away from the line WL in a direction from the second bore 84*b* toward the fourth bore 84*d*.

Specifically, two third bores 84*c* positioned at one side in the widthwise direction of the line WL extend in one widthwise direction, and remaining two third bores 84*c* positioned at the other side in the widthwise direction of the line WL extend in opposite widthwise direction. Further, the third bore 84*c* positioned farther from the line WL than the other third bore 84*c* is has a length greater than the length of the other third bore 84*c*. Hence, an interval in the widthwise direction between neighboring fourth bores 84*d* is greater than an interval between neighboring second bores 84*b*. Thus, the second connection passage 82 extends in a direction away from the line WL as it goes from the common manifold 63 connected to the first bore 84*a* and the second bore 84*b* toward the second reservoir passage 92 connected to the fourth bore 84*d* by the formation of the third bore 84*c*.

In this way, the position of the second reservoir passage 92 relative to the common manifold 63 can be adjusted by the provision of the second connection passage 82. Accordingly, the size of the second reservoir passage 92 in the widthwise direction can be greater than the size of the common manifold 63. As a result, a cross-sectional area of the second reservoir passage 92 can be greater than that of the common manifold 63, so that shortage of the liquid to be supplied to the pressure chamber 31 can be eliminated.

Fifth Embodiment

Figure 11:
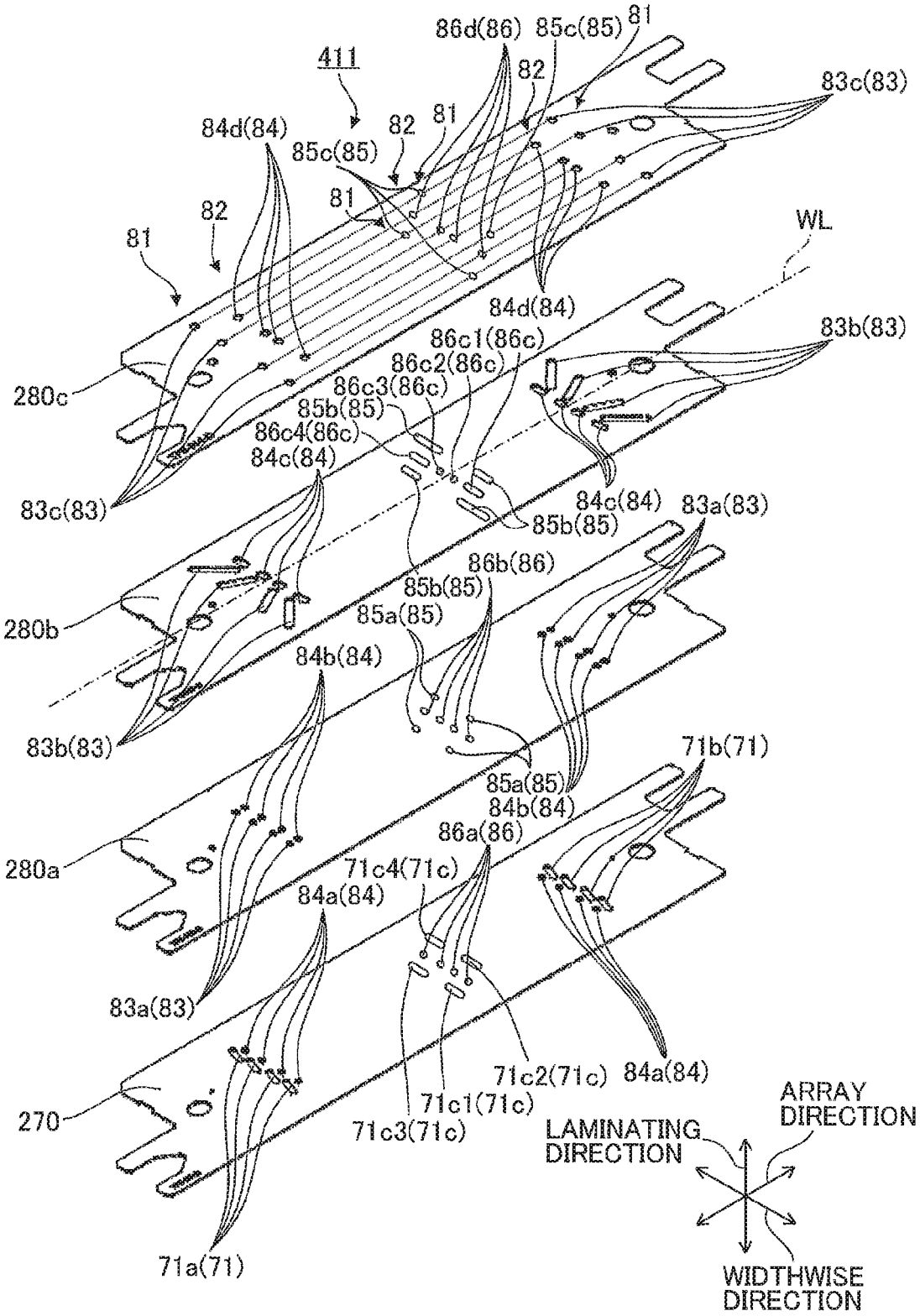
FIG. 11 is a perspective view illustrating, as viewed from above in the laminating direction, a second plate, a first connection plate, a second connection plate, and a third connection plate in the head according to a fifth embodiment.

A head 411 according to a fifth embodiment will be described with reference to FIG. 11, wherein like parts and components are designated by the same reference numerals as those shown in the foregoing embodiments. The fifth embodiment is the same as the fourth embodiment except that in the fifth embodiment, the joining passage 71*c* further includes an intermediate joining passage 71*c* in addition to the first joining passage 71*a* and the second joining passage 71*b*, the first connection passage 81 further includes a first intermediate connection passage 85 in addition to the first part 83, and the second connection passage 82 further includes a second intermediate connection passage 86 in addition to the end connection passage 84.

The first joining passage 71*a* connects together the one end portion in the array direction of the first manifold 61 and the one end portion in the array direction of the second manifold 62. The second joining passage 71*b* connects together the other end portion in the array direction of the first manifold 61 and the other end portion in the array direction of the second manifold 62. The intermediate joining passage 71 extends in the widthwise direction at a position between the first joining passage 71*a* and the second joining passage 71*b* in the array direction. The intermediate joining passage 71 connects together an intermediate portion in the array direction of the first manifold 61 and an intermediate portion in the array direction of the second manifold 62.

Thus, the liquid flows from the first manifold 61 and the second manifold 62 into the first joining passage 71*a*, the second joining passage 71*b*, and the intermediate joining passage 71*c*. Accordingly, the liquid flowing from the first manifold 61 and the second manifold 62 can be smoothly joined at the first joining passage 71*a*, the second joining passage 71*b* and the intermediate joining passage 71*c*.

Further, a plurality of the intermediate joining passages 71*c* including a first path 71*c*1, a second path 71*c*2, a third path 71*c*3, and a fourth path 71*c*4 are formed in the head 411. The first path 71*c*1 and the third path 71*c*3 are arrayed in line in the widthwise direction, and the second path 71*c*2 and the fourth path 71*c*4 are arrayed in line in the widthwise direction. Further, the array of the first path 71*c*1 and the third path 71*c*3 and the array of the 71*c*2 and the fourth path 71*c*4 are away from each other in the array direction. Since neighboring intermediate joining passages 71*c*, for example, the first path 71*c*1 and the second path 71*c*2 are not arrayed in the widthwise direction, large interval between the neighboring intermediate joining passages 71*c* in the widthwise direction can be provided, thereby avoiding leakage of the liquid.

As described above, the first part 83 is connected to the first joining passage 71*a*, the second joining passage 71*b*, and the end portion of the first reservoir passage 91. The first part 83 connected to the first joining passage 71*a* is connected to the one end portion in the array direction of the first reservoir passage 91, and the first part 83 connected to the second joining passage 71*b* is connected to the other end portion in the array direction of the first reservoir passage 91. The first part 83 includes the first hole 83*a*, the second hole 83*b*, and the third hole 83*c* as described above.

The first intermediate connection passage 85 is positioned between the pair of first parts 83 in the array direction, and is connected to the intermediate joining passage 71*c* and an intermediate position of the first reservoir passage 91. The first intermediate connection passage 85 includes a first connection part 85*a*, a second connection part 85*b*, and a third connection part 85*c*.

The first connection part 85*a* extends through a thickness of the 280*a* at a position overlapping with the first connection part 85*a* in the laminating direction. The first connection part 85*a* is connected to a center portion in the lengthwise direction of the intermediate joining passage 71*c* connected to the first manifold 61 and the second manifold 62.

The second connection part 85*b* extends through a thickness of the 280*b* at a position overlapping with the first connection part 85*a* in the laminating direction. The third connection part 85*c* extends through a thickness of the third connection plate 280*c* at a position overlapping with the second connection part 85*b* in the laminating direction.

The second connection part 85*b* extends in the widthwise direction, and has one end portion in the widthwise direction connected to the first connection part 85*a* and another end portion connected to the third connection part 85*c*. Two second connection parts 85*b* are positioned at one side of the widthwise center line WL, and remaining two second connection parts 85*b* are positioned at another side of the widthwise center line WL. In each of the set of two second connection parts 85*b* positioned at each side of the center line WL, second connection part 85*b* positioned farther from the line WL than the other second connection part 85*b* is from the center line WL has a length greater than the length of the other second connection part 85*b*. An interval between neighboring third connection parts 85*c* in the widthwise direction is greater than an interval between neighboring first connection parts 85*a* in the widthwise direction.

Thus, by way of the second connection part 85*b*, the first intermediate connection passage 85 extends in a direction away from the center line WL from the intermediate joining passage 71*c* connected to the first connection part 85*a* toward the first reservoir passage 91 connected to the third connection part 85*c*. Thus, the first reservoir passage 91 can has a width greater than that of the first manifold 61 and the second manifold 62, thereby avoiding shortage of the liquid to be supplied to the pressure chamber 31.

The third connection part 85*c* of the first intermediate connection passage 85 and the pair of third holes 83*c* arrayed with each other in the array direction are arrayed in line in the array direction. The third connection part 85*c* is the end of the first intermediate connection passage 85 connected to the first reservoir passage 91, and the pair of third holes 83*c* are the ends of the first part 83 connected to the first reservoir passage 91. In other words, the pair of first parts 83 and the first intermediate connection passage 85 are connected to the one first reservoir passage 91.

The end connection passage 84 is connected to the end portion in the array direction of the common manifold 63 and to the second reservoir passage 92. Specifically, a pair of the end connection passages 84 is provided, and one of the pair of the end connection passages 84 is connected to one end of the common manifold 63 in the array direction and to one end of the second reservoir passage 92 in the array direction. Remaining one of the pair of the end connection passages 84 is connected to the other end of the common manifold 63 in the array direction and to the other end of the second reservoir passage 92 in the array direction. The end connection passage 84 includes the first bore 84*a*, the second bore 84*b*, the third bore 84*c*, and the fourth bore 84*d* as described above.

The second intermediate connection passage 86 is connected to the intermediate position of the common manifold 63 and to the intermediate position of the second reservoir passage 92 at a position between the pair of end connection passages 84 in the array direction. The second intermediate connection passage 86 includes a first channel 86*a*, a second channel 86*b*, a third channel 86*c*, and a fourth channel 86*d*.

The first channel 86*a* extends through a thickness of the second plate 270 in the laminating direction at a position overlapped with the common manifold 63 in the laminating direction. The first channel 86*a* is in communication with the common manifold 63. A plurality of (four) first channels 86*a* are arrayed in line in the widthwise direction at a position between the first path 71*c*1 and the second path 71*c*2, and between the third path 71*c*3 and the and the fourth path 71*c*4.

The second channel 86*b* extends through a thickness of the first connection plate 280*a* in the laminating direction at a position overlapped with the first channel 86*a* in the laminating direction. The second channel 86*b* is in communication with the first channel 86*a*. The third channel 86*c* extends through a thickness of the second connection plate 280*b* in the laminating direction at a position overlapped with the second channel 86*b* in the laminating direction. The fourth channel 86*d* extends through a thickness of the third connection plate 280*c* in the laminating direction at a position overlapped with the third channel 86*c* in the laminating direction.

The third channel 86*c* includes a first section 86*c*1, a second section 86*c*2, a third section 86*c*3, and a fourth section 86*c*4 arrayed in the widthwise direction in this order. The second section 86*c*2 and the third section 86*c*3 positioned closer to the widthwise center line WL than the first section 86*c*1 and the fourth section 86*c*4 are have a circular cross-section taken along a plane perpendicular to the laminating direction. The first section 86*c*1 and the fourth section 86*c*4 positioned farther from the widthwise center line WL than the second section 86*c*2 and the third section 86*c*3 are have oblong cross-sectional shape extending in the widthwise direction taken along the plane perpendicular to the laminating direction.

Each of the first section 86*c*1 and the fourth section 86*c*4 has one end portion in its lengthwise direction connected to the second channel 86*b*, and has another end portion in its lengthwise direction connected to the fourth channel 86*d*. Thus, an interval between neighboring fourth channels 86*d* in the widthwise direction is greater than an interval between neighboring second channels 86*b* in the widthwise direction.

Thus, by way of the third channel 86*c*, the second intermediate connection passage 86 extends in a direction away from the center line WL in the widthwise direction from the common manifold 63 connected to the first channel 86*a* and the second channel 86*b* toward the second reservoir passage 92 connected to the fourth channel 86*d*. Thus, the second reservoir passage 92 can have a width greater than that of the common manifold 63, thereby avoiding shortage of the liquid to be supplied to the pressure chamber 31.

The fourth channel 86*d* of the second intermediate connection passage 86 and the pair of fourth bores 84*d* arrayed with each other in the array direction are arrayed in line in the array direction. The fourth channel 86*d* is the end of the second intermediate connection passage 86 connected to the second reservoir passage 92, and the pair of fourth bore 84*d* are the ends of the end connection passage 84 connected to the second reservoir passage 92. In other words, the pair of end connection passages 84 and the second intermediate connection passage 86 are connected to the one second reservoir passage 92.

Incidentally, in the above-described fifth embodiment, the intermediate joining passage 71*c* extends in the widthwise direction. However, the intermediate joining passage 71*c* may extend obliquely with respect to the array direction and the widthwise direction.

The above-described embodiments may be combined together as long as the combination provides no conflicting problems. The above-described technology described herein may be embodied in several forms without departing from the spirit of essential characteristics thereof. The present embodiment as described is therefore intended to be only illustrative and not restrictive, since the scope of the disclosure is defined by the appended claims rather than by the description preceding them. All changes that fall within the metes and bounds of the claims, or equivalents of such metes and bounds, are therefore intended to be embraced by the claims.

What is claimed is:

1. A liquid ejection head comprising:

a plurality of sets of a first row, a second row, and a flow path in communication with the first row and the second row, each of the plurality of sets being provided for each respective one of a plurality of kinds of liquids different from one another, wherein:

the first row comprises a plurality of first pressure chambers arrayed in line in an array direction;

the second row comprises a plurality of second pressure chambers arrayed in line in the array direction, the second row being positioned beside the first row in a widthwise direction perpendicular to the array direction; and the flow path is in communication with the plurality of first pressure chambers and the plurality of second pressure chambers, the flow path comprising:

a plurality of first communication passages each in communication with each of the first pressure chambers at a position close to the second row in the widthwise direction;

a plurality of second communication passages each in communication with each of the first pressure chambers at a position further away than the plurality of first communication passages from the second row in the widthwise direction;

a plurality of third communication passages each in communication with each of the second pressure chambers at a position close to the first row in the widthwise direction;

a plurality of fourth communication passages each in communication with each of the second pressure chambers at a position further away than the plurality of third communication passages from the first row in the widthwise direction;

a first manifold in communication with the plurality of first pressure chambers through the plurality of second communication passages;

a second manifold in communication with the plurality of second pressure chambers through the plurality of fourth communication passages; and a common manifold positioned between the first manifold and the second manifold in the widthwise direction, the common manifold being in communication with the plurality of first pressure chambers through the plurality of first communication passages and in communication with the plurality of second pressure chambers through the plurality of third communication passages.

2. The liquid ejection head according to claim 1, wherein the first manifold, the second manifold, and the common manifold extend in the array direction, the common manifold having a cross-sectional area taken along a plane perpendicular to the array direction greater than the cross-sectional area of the first manifold and the cross-sectional area of the second manifold.

3. The liquid ejection head according to claim 2, wherein the cross-sectional area of the common manifold is at least 1.6 times as large as the cross-sectional area of the first manifold and the cross-sectional area of the second manifold.

4. The liquid ejection head according to claim 1, wherein the first manifold has a length in the array direction equal to the length of the second manifold.

5. The liquid ejection head according to claim 4, wherein the first manifold is at a position different from a position of the second manifold in the array direction.

6. The liquid ejection head according to claim 1, wherein the common manifold has a length in the array direction smaller than the length of the first manifold and the length of the second manifold.

7. The liquid ejection head according to claim 1, wherein the first manifold is a return manifold into which the liquid is flowable from the plurality of first pressure chambers through the plurality of second communication passages;

wherein the second manifold is a return manifold into which the liquid is flowable from the plurality of second pressure chambers through the plurality of the fourth communication passages; and wherein the common manifold is a supply manifold from which the liquid is flowable into the plurality of first pressure chambers through the plurality of first communication passages and into the plurality of second pressure chambers through the plurality of third communication passages.

8. The liquid ejection head according to claim 1, wherein the plurality of sets comprises:

a first set through which a first liquid is configured to flow, the first set providing a first circulation passage comprising one of the first row, the second row, and the flow path; and a second set through which a second liquid different from the first liquid is configured to flow, the second set providing a second circulation passage independent of the first circulation passage, the second circulation passage comprising another one of the first row, the second row and the flow path different from the first row, the second row, and the flow path of the first set, respectively;

wherein the second row of the first set and the first row of the second set are positioned adjacent to each other;

wherein in the first set, the first manifold is a return manifold into which the first liquid is flowable from the plurality of first pressure chambers through the plurality of second communication passages;

the second manifold is a return manifold into which the first liquid is flowable from the plurality of second pressure chambers through the plurality of the fourth communication passages; and the common manifold is a supply manifold from which the first liquid is flowable into the plurality of first pressure chambers through the plurality of first communication passages and into the plurality of second pressure chambers through the plurality of third communication passages, wherein in the second set, the first manifold is a supply manifold from which the second liquid is flowable into the plurality of first pressure chambers through the plurality of second communication passages;

the second manifold is a supply manifold from which the second liquid is flowable into the plurality of second pressure chambers through the plurality of the fourth communication passages; and the common manifold is a return manifold into which the second liquid is flowable from the plurality of first pressure chambers through the plurality of first communication passages and from the plurality of second pressure chambers through the plurality of third communication passages.

9. The liquid ejection head according to claim 1, wherein the flow path further comprises a joining passage connected to the first manifold and the second manifold.

10. The liquid ejection head according to claim 9, wherein the joining passage is overlapped with the first manifold in a laminating direction perpendicular to the array direction and the widthwise direction at a position opposite to the second communication passage with respect to the first manifold, and the joining passage is also overlapped with the second manifold in the laminating direction at a position opposite to the fourth communication passage with respect to the second manifold.

11. The liquid ejection head according to claim 9, wherein the joining passage has one end and another end in a lengthwise direction thereof, the one end being at a position not farther from the fourth communication passage than the second communication passage is from the fourth communication passage, and the other end being at a position not farther from the second communication passage than the fourth communication passage is from the second communication passage.

12. The liquid ejection head according to claim 9, wherein the first manifold has end portions in the array direction, and the second manifold has end portions in the array direction; and wherein the joining passage is connected to the end portion of the first manifold and the end portion of the second manifold.

13. The liquid ejection head according to claim 9, wherein the first manifold and the second manifold have downstream end portions in a flowing direction of the liquid flowing therethrough, the joining passage being connected to the downstream end portions.

14. The liquid ejection head according to claim 9, wherein the joining passage extends in its lengthwise direction, the lengthwise direction and the array direction defining an angle therebetween which is greater than zero and smaller than 90 degrees.

15. The liquid ejection head according to claim 9, wherein the flow path further comprises:

a first reservoir passage connected to a tank of the liquid;

a first connection passage through which the joining passage is connected to the first reservoir passage;

a second reservoir passage connected to the tank; and a second connection passage through which the second reservoir passage is connected to the common manifold.

16. The liquid ejection head according to claim 15, wherein the first manifold is one of a plurality of first manifolds and the second manifold is one of a plurality of second manifolds; and wherein the first connection passage extends in a direction away from a center in the widthwise direction of an array of the plurality of first manifolds and the plurality of second manifolds from the joining passage toward the first reservoir passage.

17. The liquid ejection head according to claim 15, wherein the joining passage has one end portion and another end portion in a lengthwise direction, the one end portion being connected to the first manifold and the other end portion being connected to the second manifold; and wherein the first connection passage is connected to a center portion in the lengthwise direction between the one end portion and the other end portion of the joining passage.

18. The liquid ejection head according to claim 15, wherein the second manifold is one of a plurality of second manifolds;

wherein the first manifold, the plurality of second manifolds, and the common manifold have end portions and intermediate portions in the array direction;

wherein the joining passage comprises:

an end joining passage through which the end portion of the first manifold and the end portion of the second manifold are connected together; and an intermediate joining passage through which the intermediate portion of the first manifold and the intermediate portion of the second manifold are connected together;

wherein the first connection passage comprises:

a first end connection passage through which the end joining passage is connected to the first reservoir passage; and a first intermediate connection passage through which the intermediate joining passage is connected to the first reservoir passage;

wherein the second connection passage comprises:

a second end connection passage through which the end portion of the common manifold is connected to the second reservoir passage; and a second intermediate connection passage through which the intermediate portion of the common manifold is connected to the second reservoir passage.

19. The liquid ejection head according to claim 18, wherein the first manifold is one of a plurality of first manifolds;

wherein the first intermediate connection passage extends in a direction away from a center in the widthwise direction of an array of the plurality of first manifolds and the plurality of second manifolds from the intermediate joining passage toward the first reservoir passage; and wherein the second intermediate connection passage extends in a direction away from the center in the widthwise direction of an array of the plurality of first manifolds and the plurality of second manifolds from the common manifold toward the second reservoir passage.

20. The liquid ejection head according to claim 18, wherein the end joining passage is connected to each end portion in the array direction of the first manifold and to each end portion in the array direction of the second manifold, so that a pair of end joining passages are provided;

wherein the first end connection passage is connected to each end joining passage, so that a pair of first end connection passages are provided, each first end connection passage having each end providing a pair of ends directly connected to the first reservoir passage;

wherein the first intermediate connection passage has an end directly connected to the first reservoir passage, the pair of ends of the first end connection passages and the end of the first intermediate connection passage being aligned with each other in the array direction;

wherein the second end connection passage is connected to each end portion in the array direction of the common manifold, so that a pair of second end connection passages are provided, each second end connection passage having an end directly connected to the second reservoir passage, so that a pair of ends of the second end connection passages are provided; and wherein the second intermediate connection passage has an end directly connected to the second reservoir passage, the pair of ends of the second end connection passages and the end of the second intermediate connection passage being aligned with each other in the array direction.

21. A liquid ejection device comprising:

a first plate formed with the first manifold, the second manifold, and the common manifold according to claim 1;

a damper plate laminated on the first plate, and elastically deformable; and a second plate laminated on the damper plate, the second plate having a surface facing the damper plate, the surface being formed with damper grooves, one of the damper grooves being positioned in overlapping relation with the first manifold, another one of the damper grooves being positioned in overlapping relation with the second manifold and still another one of the damper grooves being positioned in overlapping relation with the common manifold in a laminating direction perpendicular to the array direction and the widthwise direction.

* * * * *